US010697627B1

(12) United States Patent
Fukushima et al.

(10) Patent No.: US 10,697,627 B1
(45) Date of Patent: Jun. 30, 2020

(54) ILLUMINATION APPARATUS

(71) Applicants: KILT PLANNING OFFICE INC., Kawasaki-shi, Kanagawa (JP); KANEKA CORPORATION, Osaka-shi, Osaka (JP)

(72) Inventors: Koichi Fukushima, Iruma-gun (JP); Toyohisa Shozo, Kawasaki (JP); Youichi Yamaguchi, Tokyo (JP); Tomoki Kubo, Tokyo (JP)

(73) Assignees: KILT PLANNING OFFICE INC., Kawasaki-Shi, Kanagawa (JP); KANEKA CORPORATION, Osaka-Shi, Osaka (JP)

( * ) Notice: Subject to any disclaimer, the term of this patent is extended or adjusted under 35 U.S.C. 154(b) by 0 days.

(21) Appl. No.: 16/634,084

(22) PCT Filed: Jun. 3, 2019

(86) PCT No.: PCT/JP2019/021990

§ 371 (c)(1),
(2) Date: Jan. 24, 2020

(87) PCT Pub. No.: WO2020/003911

PCT Pub. Date: Jan. 2, 2020

(30) Foreign Application Priority Data

Jun. 26, 2018 (JP) ..... 2018-120761

(51) Int. Cl.
*F21V 29/83* (2015.01)
*F21V 29/503* (2015.01)
(Continued)

(52) U.S. Cl.
CPC ..... *F21V 29/83* (2015.01); *F21V 17/12* (2013.01); *F21V 23/002* (2013.01);
(Continued)

(58) Field of Classification Search
CPC combination set(s) only.
See application file for complete search history.

(56) References Cited

U.S. PATENT DOCUMENTS 10,443,794 B2 * 10/2019 Tanaka ..... F21V 11/00
2019/0049076 A1 2/2019 Tanaka et al.

FOREIGN PATENT DOCUMENTS

JP 2016170920 A 9/2016
JP 2018060681 A 4/2018
JP 2018092911 A 6/2018

* cited by examiner

*Primary Examiner* — Bao Q Truong
(74) *Attorney, Agent, or Firm* — Alleman Hall Creasman & Tuttle LLP

(57) ABSTRACT

The present invention provides an illumination apparatus that can suppress heat generation during use. The illumination apparatus includes a planar light emitting panel and a heat-radiating mounting member. The mounting member mounts the planar light emitting panel and has a body plate-section. The body plate-section has a through hole for feeding power that penetrates the body plate-section in a thickness direction, and a smooth region substantially free of protrusions. The panel has a panel body and a connecting wiring section. The connecting wiring section electrically connects the panel body to an external power source, and extends through the through hole. The panel has a front surface including a light emitting region that emits light, and a back surface on which another smooth region is provided. The smooth regions are in surface contact with each other over not less than 50% of an area of the light emitting region.

22 Claims, 12 Drawing Sheets

(51) Int. Cl.

| | |
|---|---|
| ***F21V 23/00*** | (2015.01) |
| ***F21V 17/12*** | (2006.01) |
| *F21W 131/405* | (2006.01) |
| *F21Y 115/15* | (2016.01) |

(52) U.S. Cl.
CPC ..... *F21V 23/003* (2013.01); *F21V 29/503* (2015.01); *F21W 2131/405* (2013.01); *F21Y 2115/15* (2016.08)

ILLUMINATION APPARATUS

TECHNICAL FIELD

The present invention relates to an illumination apparatus. In particular, the present invention relates to an illumination apparatus that is suitably used for a display shelf for a food item such as bread or a cultural asset such as a scroll.

BACKGROUND ART

Since an organic EL panel, an inorganic EL panel, and a planar light emitting panel in which LEDs are disposed in a planar shape emit light in a planar shape, they generate smaller amount of heat per output than that of a point light source and can illuminate a wide range (for example, Patent Document 1). Therefore, in recent years, the organic EL panel, the inorganic EL panel, and the planar light emitting panel are expected as illumination apparatuses that illuminate a food item such as bread or a cultural asset such as a scroll. That is, by using the planar light emitting panel as an illumination apparatus for a food item such as bread or a cultural asset such as a scroll, drying and thermal deterioration of an exhibit can be further suppressed as compared to a case of using a point light source.

PRIOR ART DOCUMENTS

Patent Documents

Patent Document 1: JP 2016-170920 A

DISCLOSURE OF INVENTION

Technical Problem

As described above, the planar light emitting panel, which is a planar light source, can further suppress heat generation than a point light source such as an LED. However, even if the planar light emitting panel is used, if a food item or a cultural asset is illuminated for a long time, heat is transferred to the food item or the cultural asset due to the heat generated in a light emitting section during lighting, and the food item or the cultural asset is dried, resulting in deterioration in taste and quality. Therefore, further improvement has been desired.

Therefore, an object of the present invention is to provide an illumination apparatus which can suppress heat generation during lighting of a planar light emitting panel.

Solution to Problem

One aspect of the present invention for solving the above-described problems provides an illumination apparatus including: a planar light emitting panel; and a heat-radiating mounting member having a body plate-section, wherein the heat-radiating mounting member is configured to mount the planar light emitting panel on a mounted section, wherein the body plate-section includes: a first through hole for feeding power that penetrates the body plate-section in a thickness direction; and a mounting-side smooth region that includes substantially no protrusion, wherein the planar light emitting panel includes: a panel body; and a connecting wiring section, wherein the connecting wiring section is configured to electrically connect the panel body to an external power source, the connecting wiring section traveling from a panel-body side of the body plate-section to an opposite side of the body plate-section through the first through hole, wherein the planar light emitting panel includes: a front surface that is constituted by a light emitting surface including a light emitting region that emits light during lighting; and a back surface that includes a panel-side smooth region including substantially no protrusion, and wherein the mounting-side smooth region and the panel-side smooth region are in surface contact with each other in an area not less than 50 percent of the light emitting region in plan view of the light emitting surface.

The "mounted section" herein refers to a portion to which the illumination apparatus is to be mounted, and refers to a portion of a structure different from the illumination apparatus, such as a ceiling, a wall, a floor, a shelf, or the like.

The "does not substantially include a protrusion" herein means that a protrusion having an elevation difference of not less than 10 μm with respect to a center line is not included. The "center line" herein is a line which makes the sum of the area from the center line to a recessed portion equal to the sum of the area from the center line to the protruded section.

According to the present aspect, since the connecting wiring section extends from the panel-body side of the body plate-section to the opposite side through the through hole for feeding power, the illumination apparatus can be mounted without interposing a feed element that controls power feeding to the panel body of the planar light emitting panel between the panel body and the body plate-section. Therefore, the thickness from the heat-radiating mounting member can be reduced, and it is possible to prevent heat generated during power feeding of the feed element from being transferred to the panel body.

Furthermore, according to the present aspect, the mounting-side smooth region and the panel-side smooth region are in surface contact with each other in the area of not less than 50 percent of the area of the light emitting region. Therefore, the area for transferring heat from the planar light emitting panel to the heat-radiating mounting member is large, heat generated in the light emitting region can be released from a surface to the heat-radiating mounting member, and a temperature rise of the light emitting surface of the planar light emitting panel during lighting can be suppressed.

One aspect of the present invention provides an illumination apparatus including: a planar light emitting panel; and a heat-radiating mounting member having a body plate-section and a feed element, wherein the heat-radiating mounting member is configured to support and mount the planar light emitting panel on a mounted section, wherein the body plate-section includes: a first through hole for feeding power that penetrates the body plate-section in a thickness direction; and a mounting-side smooth region that includes substantially no protrusion, wherein the feed element is located to an opposite side to the planar light emitting panel with respect to the body plate-section and is electrically connected to an external power source, wherein the planar light emitting panel includes: a panel body; and a connecting wiring section, wherein the connecting wiring section is configured to connect the panel body to the feed element through the first through hole, wherein the planar light emitting panel includes: a front surface that is constituted by a light emitting surface including a light emitting region that emits light during lighting; and a back surface that includes a panel-side smooth region including substantially no protrusion, and wherein the mounting-side smooth region and the panel-side smooth region are in surface contact with each other in an area not less than 50 percent of the light emitting region in plan view of the light emitting surface.

According to the present aspect, since the feed element is located opposite to the planar light emitting panel with respect to the body plate-section, the feed element is isolated from the planar light emitting panel by the body plate-section. Therefore, even if the feed element generates heat due to power feeding or the like, the body plate-section soaks the heat. Therefore, the heat is hard to transfer to the planar light emitting panel, and a temperature rise of the light emitting surface of the planar light emitting panel can be suppressed.

According to the present aspect, the mounting-side smooth region and the panel-side smooth region are in surface contact with each other in the area of not less than 50 percent of the area of the light emitting region. Therefore, the area for transferring heat from the planar light emitting panel to the heat-radiating mounting member is large, heat generated in the light emitting region can be released from a surface to the heat-radiating mounting member, and a temperature rise of the light emitting surface of the planar light emitting panel can be suppressed.

In a preferred aspect, the illumination apparatus further includes at least two of the planar light emitting panels, wherein the heat-radiating mounting member holds the at least two of the planar light emitting panels at a predetermined interval, and wherein a shortest distance between the at least two of the planar light emitting panels is greater than a length of the planar light emitting panels.

According to the present aspect, heat is less likely to interfere between the respective planar light emitting panels, and heat generated in one planar light emitting panel is hard to transfer to another planar light emitting panel. Therefore, it is possible to suppress an increase in temperature of the light emitting surface of the one planar light emitting panel due to heat generation of the other planar light emitting panel.

In a preferred aspect, the illumination apparatus further includes a plurality of the planar light emitting panels, wherein the heat-radiating mounting member is long-sized, thereby holding the plurality of the planar light emitting panels linearly side by side in a longitudinal direction.

According to the present aspect, the illumination apparatus can function as a long lamp.

In a preferred aspect, the body plate-section is made of a galvanized steel plate.

According to the present aspect, the dust-free illumination apparatus is provided that is inexpensive and excellent in appearance, and that hardly contaminates a food item or the like when used as lighting for the food item or the like.

In a case of newly mounting an illumination apparatus or changing the type of the illumination apparatus, there may be a demand for mounting the illumination apparatus on an existing display shelf. In such a case, in order to secure a display space for a display object in a limited space, it is necessary to reduce the thickness of the illumination apparatus as much as possible.

Therefore, in a preferred aspect, a maximum thickness of a portion where the planar light emitting panel is mounted on the heat-radiating mounting member is not greater than 20 mm.

According to the present aspect, since the illumination apparatus is thin, post-installation of the illumination apparatus to a mounted section of an existing display shelf or the like can be easily realized without selecting the installation location.

In a preferred aspect, the planar light emitting panel includes a back-surface supporting case that supports a back surface side of the panel body, the back-surface supporting case having a second through hole for heat transfer, the second through hole exposing part of the back surface of the panel body, and the illumination apparatus further includes a heat transfer member that blocks most part of the second through hole, the heat transfer member being constituted by a metal plate, the heat transfer member including: one principal surface in surface contact with the panel body; and an other principal surface in surface contact with the body plate-section.

According to the present aspect, since the heat transfer member is interposed between the panel body and the body plate-section, and the heat transfer member is in surface contact with each of the panel body and the body plate-section, heat is easily released from the panel body to the body plate-section via the heat transfer member.

In a preferred aspect, the planar light emitting panel includes a back-surface supporting case that supports a back surface side of the panel body, the back-surface supporting case including a body section and a projecting section that projects from the body section, the projecting section including a fastening hole that has a depth from a distal end section toward a base end section in a projecting direction, the body plate-section of the heat-radiating mounting member includes a third through hole for fixing a panel, the third through hole being configured to house the projecting section, and the planar light emitting panel is mounted on the heat-radiating mounting member by housing the projecting section in the third through hole and fastening a first fastening element in the fastening hole.

The "fastening element" herein is a more generic concept of a screw, a nail, a rivet, and the like.

According to the present aspect, since the projecting section is accommodated in the through hole for fixing the panel and the first fastening element and the fastening hole are fastened in this state, the overall thickness can be further reduced.

In a preferred aspect, the heat-radiating mounting member includes: a feed element that is electrically connected to the external power source, the feed element being located to the opposite side to the planar light emitting panel with respect to the body plate-section; and a cover member that covers and protects the feed element and part of the connecting wiring section, together with the body plate-section.

According to the present aspect, since the feed element and part of the connecting wiring section are protected by the cover member, even in the case of fixation to a mounted section of a wooden shelf, for example, it is possible to prevent the feed element and part of the connecting wiring section from directly contacting the mounted section of the shelf, and high safety is realized.

In a more preferred aspect, the illumination apparatus further includes: a second fastening element; and a push nut, the second fastening element including: a shaft section; and a cylindrical section that surrounds the shaft section, the push nut including: an annular base section; and a claw section that extends toward a center from the annular base section, wherein the second fastening element is provided across the cover member and the heat-radiating mounting member, the cover member being fixed to the heat-radiating mounting member by the claw section engaging with an outer peripheral surface of the cylindrical section, the heat-radiating mounting member being mounted by inserting the shaft section of the second fastening element into the mounted section.

According to the present aspect, since the cover member can be temporarily fixed to the heat-radiating mounting member by the push nut, mounting work to the mounted section becomes easy.

In a preferred aspect, the heat-radiating mounting member includes: a power input board that inputs power from the external power source; a control board that controls output of the power to the planar light emitting panel; and an internal wiring member that connects the power input board to the control board.

According to the present aspect, since the power input board, the control board, and the internal wiring member are provided on the heat-radiating mounting member, it is easy to feed power from the external power source.

In a preferred aspect, the heat-radiating mounting member includes: an external wiring member that inputs power from the external power source to a power input board: and a wiring fixing member that fixes the external wiring member, the external wiring member being at least partially bendable, the wiring fixing member having a bent groove that houses part of the external wiring member in a bent state, the bent groove including a locking piece that locks movement of the external wiring member.

According to the present aspect, since movement of the external wiring member is restricted by the wiring fixing member, it is possible to prevent an excessive load from being applied to the power input board to be connected by being pulled by the external wiring member. Therefore, disconnection of the external wiring member or the connected section between the external wiring member and the power input board can be prevented.

Effect of Invention

According to the illumination apparatus of the present invention, it is possible to suppress heat generation during lighting of the planar light emitting panel.

BRIEF DESCRIPTION OF DRAWINGS

FIGS. 5A and 5B are explanatory views of the illumination apparatus illustrated in FIG. 2, wherein FIG. 5A is a front view, and FIG. 5B is a back view.

FIGS. 6A and 6B are cross-sectional views of the illumination apparatus illustrated in FIG. 5A, wherein FIG. 6A is an A-A cross-sectional view, and FIG. 5B is a B-B cross-sectional view.

FIGS. 15A to 15C are explanatory views of measurement points of temperature rise measurement of the present invention, wherein FIG. 15A is a front view of a light emitting surface, FIG. 15B is a view in the direction of arrow X1 in FIG. 15A, and FIG. 15C is a view in the direction of arrow Y1 in FIG. 15A.

BEST MODE FOR CARRYING OUT THE INVENTION

Hereinafter, embodiments of the present invention will be described in detail. Note that the positional relationship is based on the normal installation positions. It is assumed that a light emitting surface 9 side is the front and a mounted surface 200 side is the back.

Figure 1:
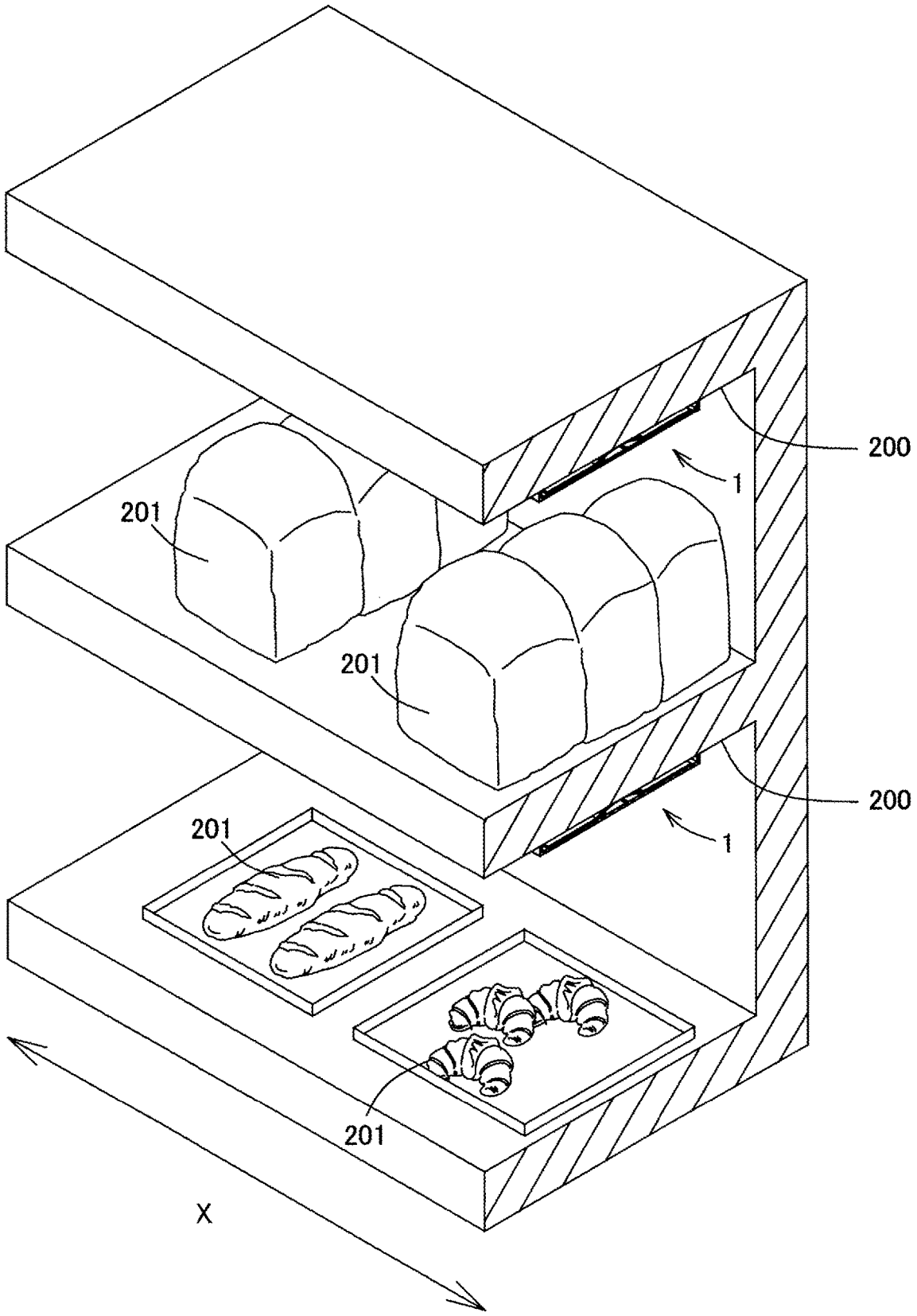
FIG. 1 is a perspective view illustrating an installation state of an illumination apparatus according to a first embodiment of the present invention.

As illustrated in FIG. 1, an illumination apparatus 1 according to a first embodiment of the present invention is installed on the mounted surface 200 (mounted section) under a display shelf where food items 201 such as bread are displayed side by side. That is, the illumination apparatus 1 functions as illumination under the shelf for display of the food items 201.

Figure 2:
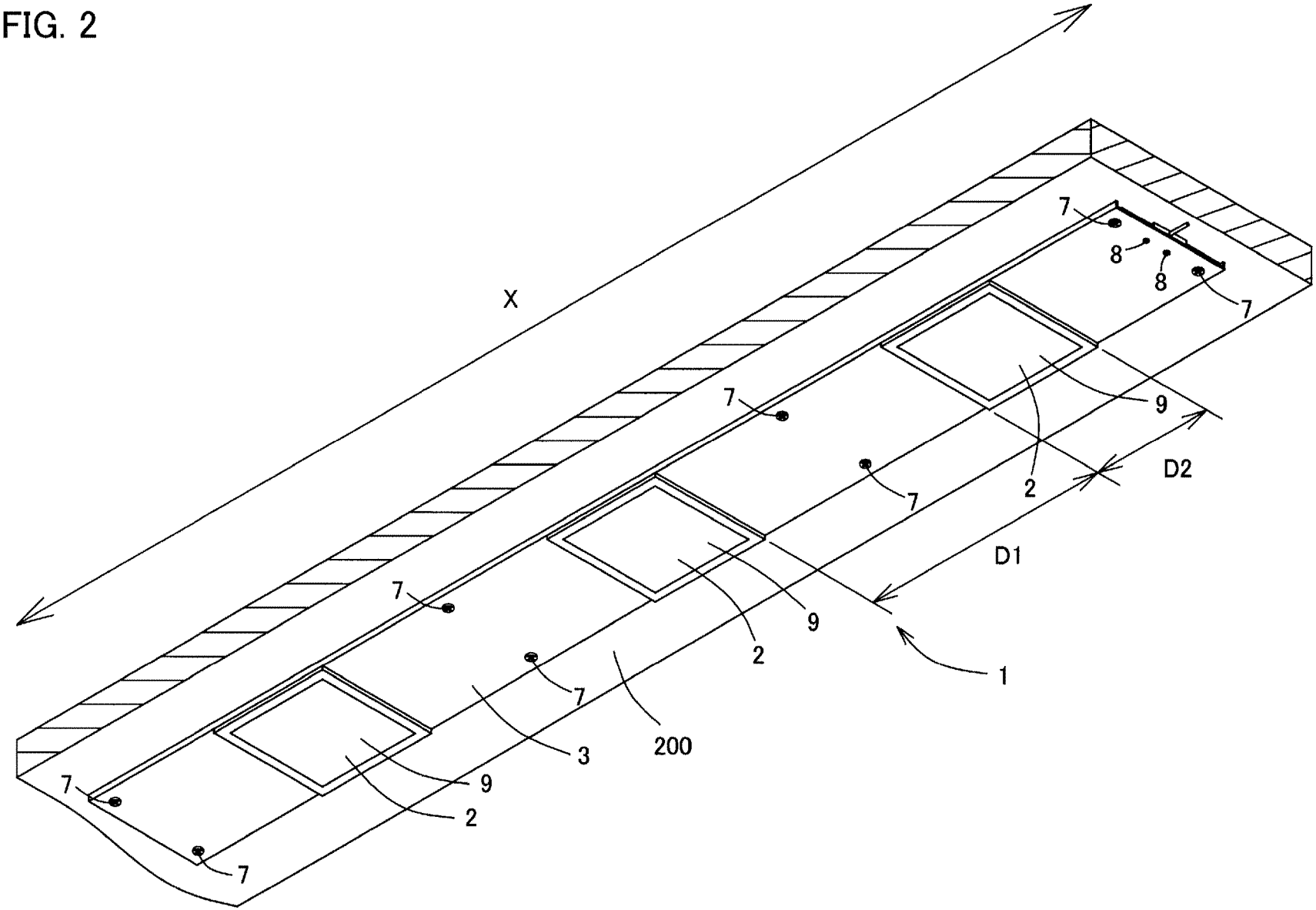
FIG. 2 is a perspective view of the illumination apparatus illustrated in FIG. 1.

As illustrated in FIG. 2, the illumination apparatus 1 is a long lamp in which planar light emitting panels 2 are mounted on a long heat-radiating mounting member 3 at intervals in the longitudinal direction (hereinafter also referred to as the length direction X).

Figure 3:
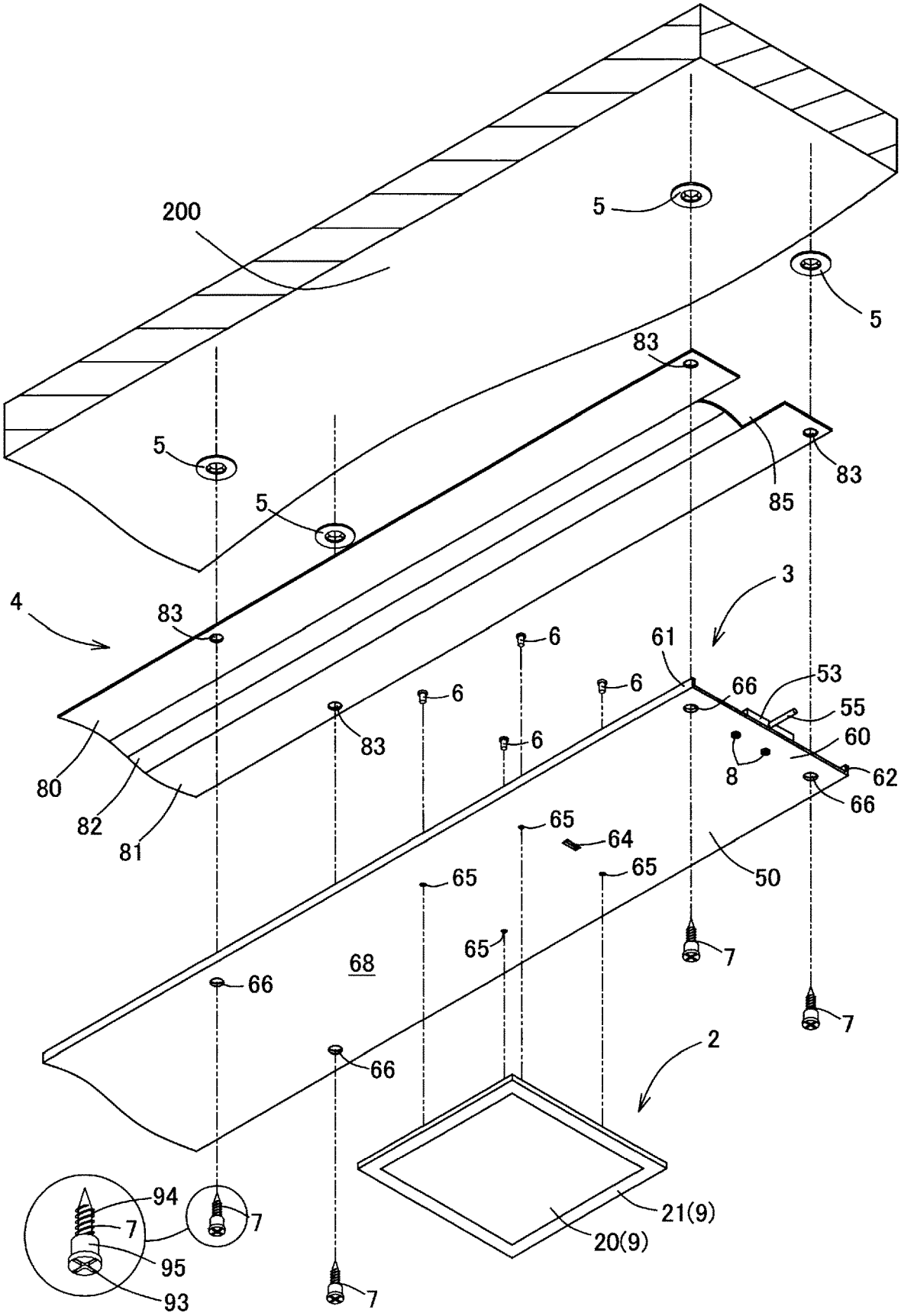
FIG. 3 is an exploded perspective view of the illumination apparatus illustrated in FIG. 2.
Figure 4:
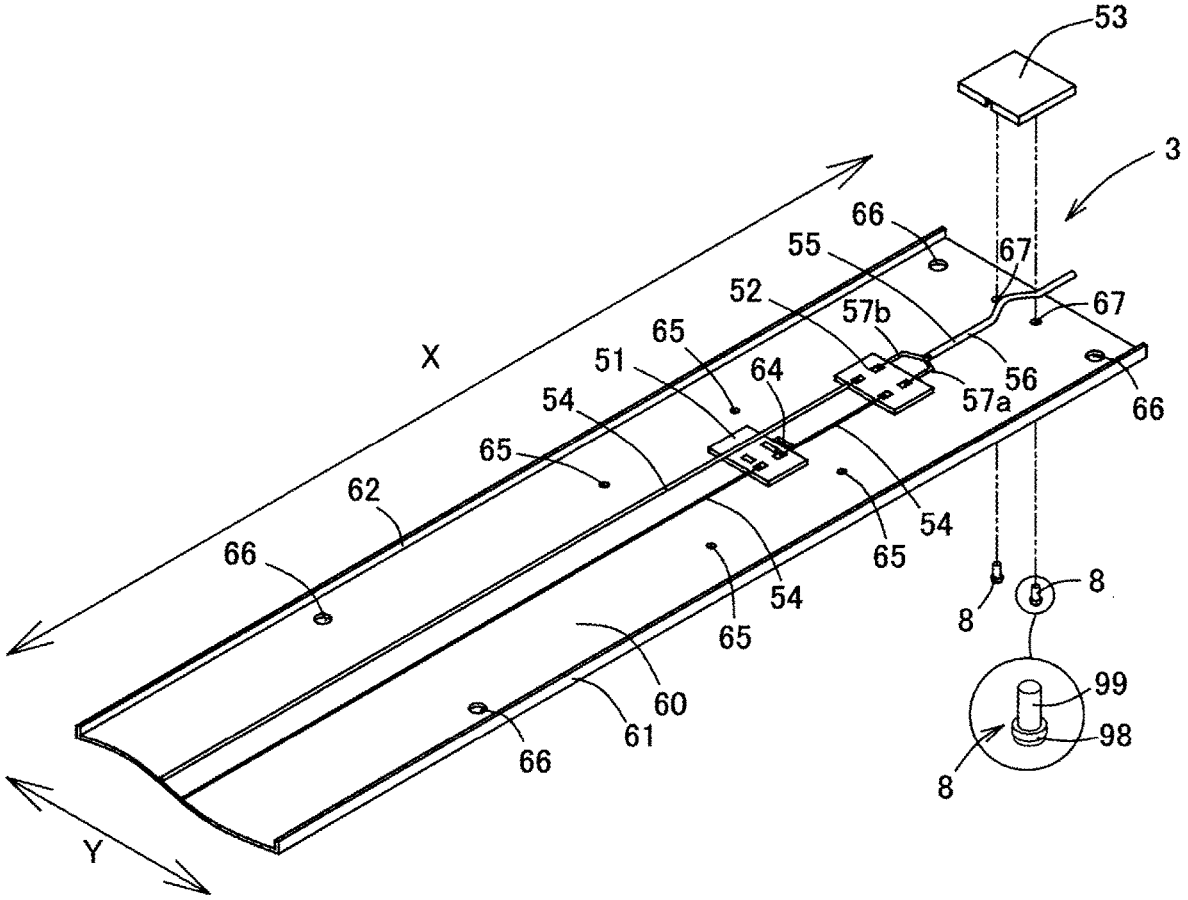
FIG. 4 is an exploded perspective view of a heat-radiating mounting member illustrated in FIG. 3.

As illustrated in FIGS. 3 and 4, the illumination apparatus 1 includes the planar light emitting panel 2, the heat-radiating mounting member 3, a cover member 4, a push nut 5, a first fastening element 6, a second fastening element 7, and a third fastening element 8.

Figure 9:
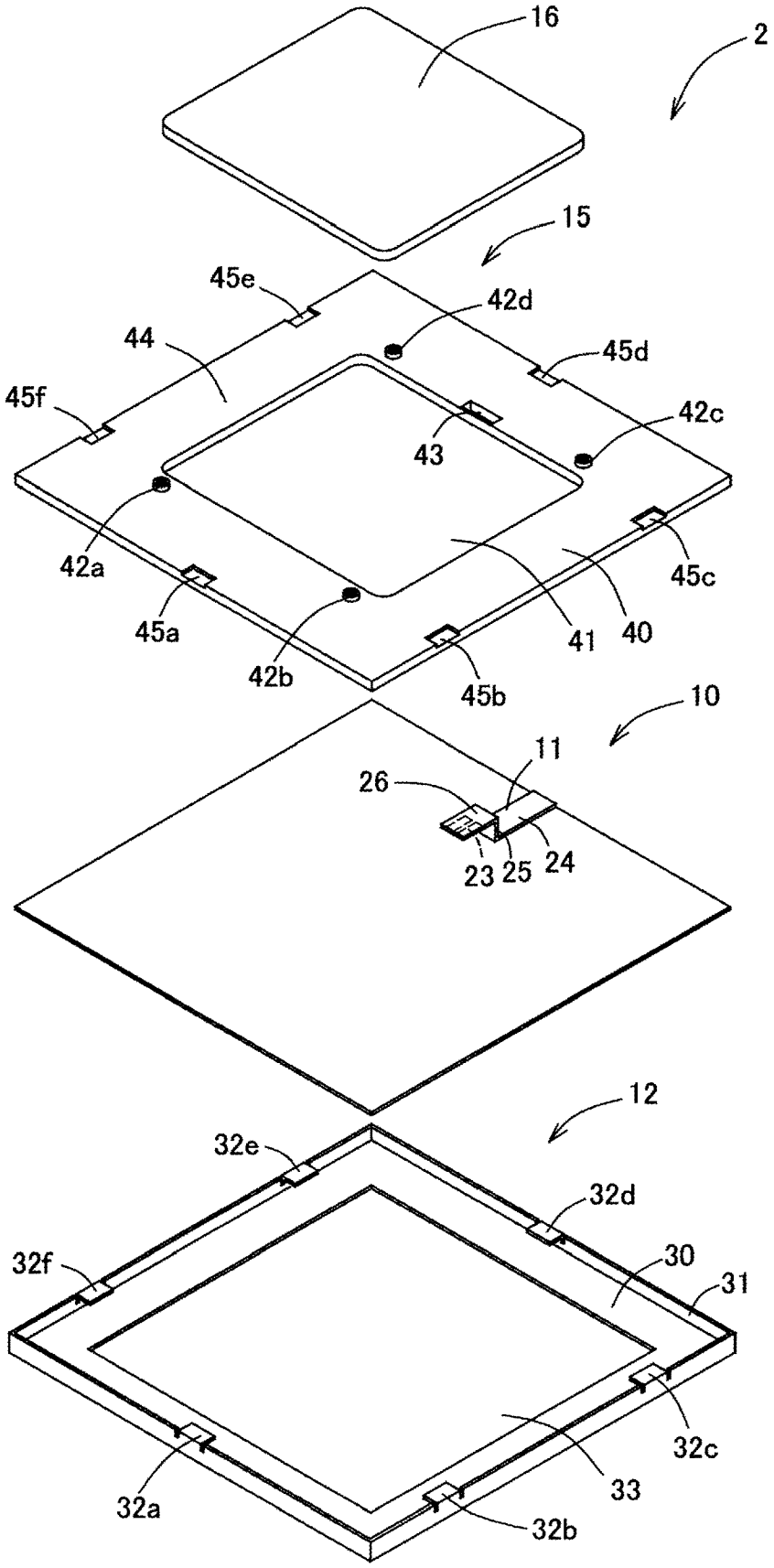
FIG. 9 is an exploded perspective view of the planar light emitting panel illustrated in FIG. 8.

As illustrated in FIG. 3, the planar light emitting panel 2 is a quadrangular plate-shaped panel, and is a light emitting panel in which one surface becomes the light emitting surface 9. Specifically, the planar light emitting panel 2 is an organic EL panel, and as illustrated in FIG. 9, includes a panel body 10, a connecting wiring section 11, a first case 12 (first frame), and a second case 15 (second case) (back-surface supporting case, back-surface supporting frame), and a heat transfer member 16.

Figure 5A:
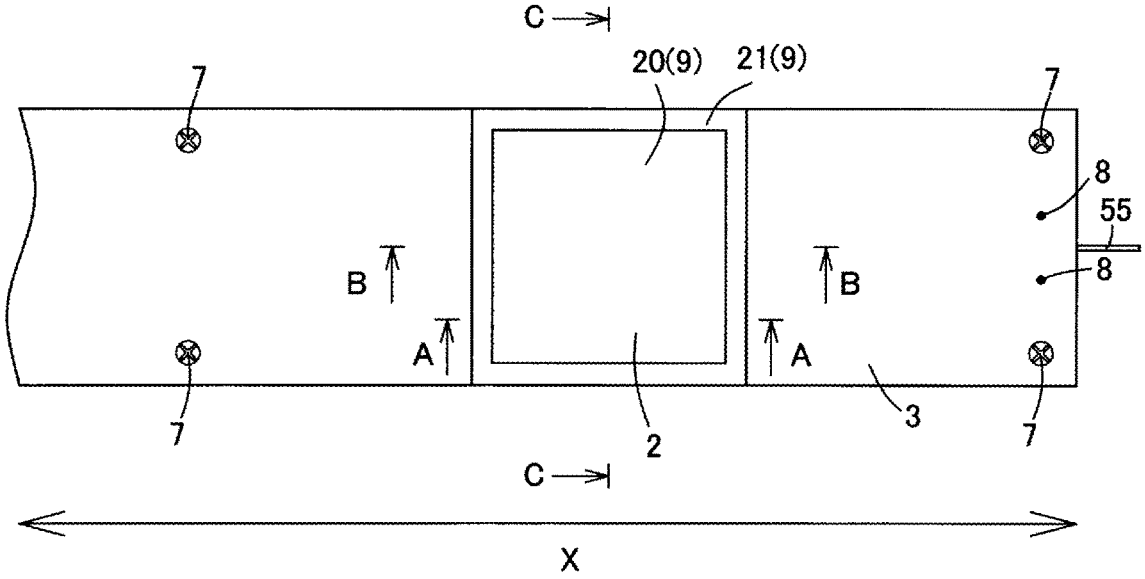

As illustrated in FIG. 5A, the planar light emitting panel 2 has a light emitting region 20 formed in the center when the light emitting surface 9 is viewed from the front, and a frame region 21 formed so as to surround the light emitting region 20.

The light emitting region 20 is a light radiating region that radiates light generated by light emission from an incorporated light emitting element during lighting, and can radiate light in a desired emission color. The light emitting region 20 has a shape similar to edges of the panel body 10, and specifically has a quadrangular shape.

The frame region 21 is a region other than the light emitting region 20 in the light emitting surface 9, and is a non-light emitting region that does not emit light during lighting. The frame region 21 is continuous in an annular shape around the light emitting region 20, and specifically has a quadrangular annular shape.

Figure 6A:
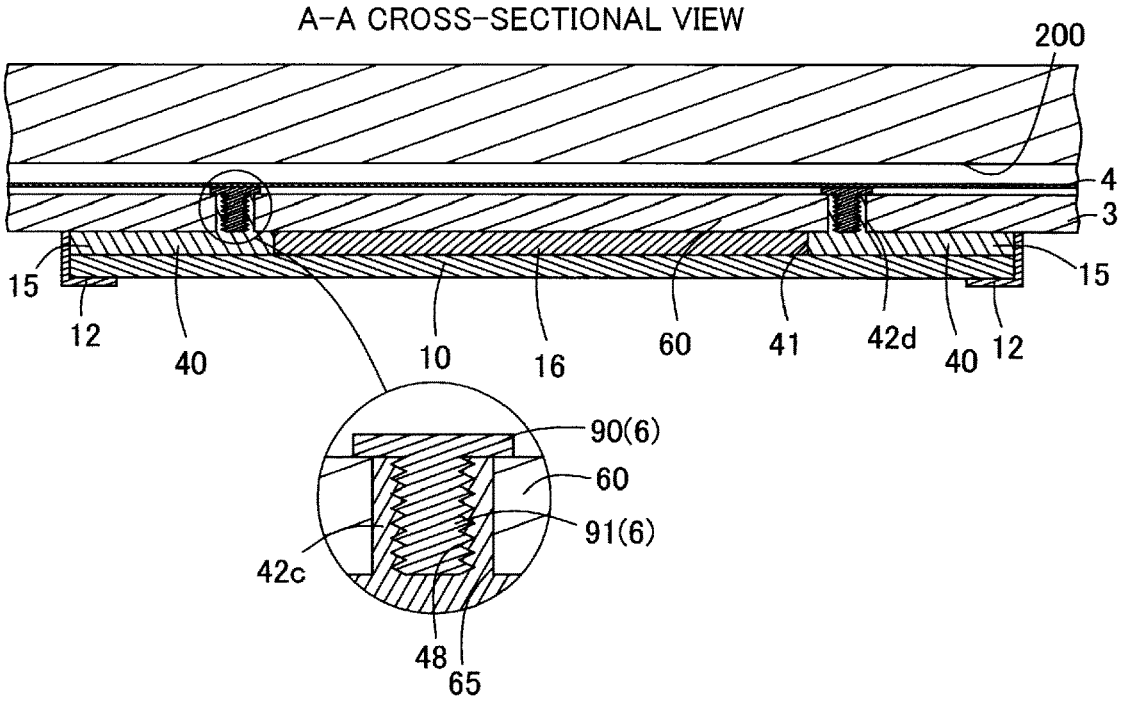
Figure 6B:
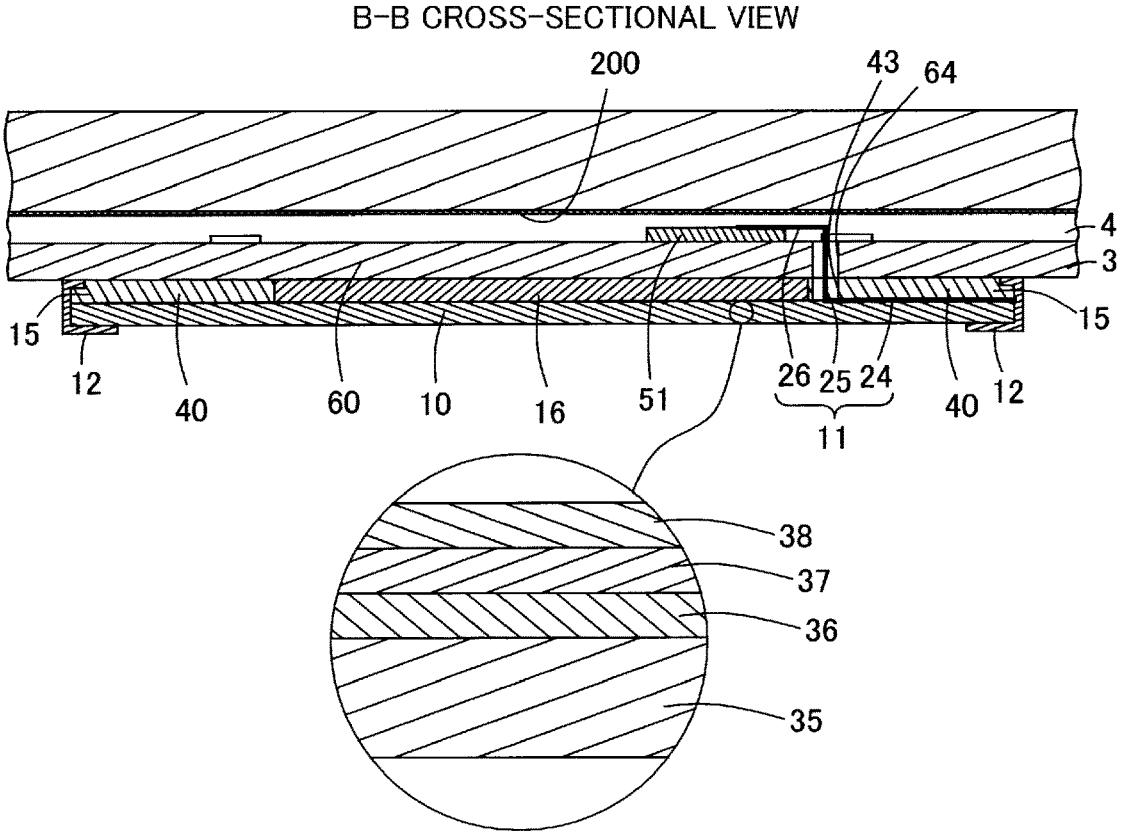

As illustrated in FIG. 6B, the panel body 10 is an organic EL tile which incorporates an organic EL element 36 which is a light emitting element, and the organic EL element 36 can emit light by being fed with power from the outside. The organic EL element 36 is obtained by sandwiching an organic light emitting layer between two electrode layers facing each other, and has a planar shape.

The panel body 10 of the present embodiment employs a high color-rendering organic EL tile having an average color rendering index Ra not less than 90.

As illustrated in FIG. 6B, the panel body 10 has a laminated structure in which the organic EL element 36 is laminated on a substrate 35 and sealed with a sealing layer 37, and a soaking sheet 38 is laminated on a projection surface in the thickness direction of the organic EL element 36 outside the sealing layer 37. That is, the panel body 10 is configured such that the soaking sheet 38 is incorporated on the back surface side, and soaks heat of the light emitting section by a surface. In other words, the soaking sheet 38 covers the back surface side of the organic EL element 36.

The soaking sheet 38 is not particularly limited as long as the soaking sheet 38 can soak heat generated during lighting, and, for example, a graphite sheet or an aluminum sheet can be adopted.

As illustrated in FIG. 9, the connecting wiring section 11 is a portion that is provided on the back surface of the panel body 10 and is electrically connected to the organic EL element 36 inside the panel body 10.

The connecting wiring section 11 is a portion extending in a tongue shape from the vicinity of the end of the panel body 10. That is, the connecting wiring section 11 has a band shape, is supported in a cantilevered manner from the vicinity of the edge of the panel body 10, and includes a panel-side connector section 23 at the distal end section thereof.

The connecting wiring section 11 is composed of a flexible wiring board, incorporates metal wiring, which is not illustrated, and can be elastically deformed.

When the illumination apparatus 1 is assembled, the connecting wiring section 11 is partially bent to form a step. The connecting wiring section 11 includes a first wiring section 24 and a third wiring section 26 different in height in the thickness direction of the panel body 10, and a second wiring section 25 that connects the first wiring section 24 and the third wiring section 26. The panel-side connector section 23 is provided on the third wiring section 26 on the second case 15 side with respect to the first wiring section 24.

As illustrated in FIG. 9, the first case 12 is a light emitting supporting case that forms a pair with the second case 15 and covers the light emitting surface 9 side of the panel body 10. The first case 12 includes a light emitting-side covering section 30, an end surface-side covering section 31, and engaging pieces 32*a* to 32*f*

The light emitting-side covering section 30 is a portion that covers the frame region 21 of the light emitting surface 9 of the panel body 10, and includes a take-out opening 33 provided at the center, for taking out light radiated from the panel body 10.

The end surface-side covering section 31 is a portion that covers the end surfaces of the panel body 10, and rises from the ends of the light emitting-side covering section 30.

The engaging pieces 32*a* to 32*f* are locking pieces that engage with the second case 15 to lock separation of the second case 15 from the first case 12, and are claw-shaped portions bent from the ends of the end surface-side covering section 31 in the rising direction.

The second case 15 is a back-surface supporting case that covers the back surface side (heat-radiating mounting member 3 side) of the panel body 10, and is a resin case formed from an insulating resin such as polycarbonate.

As illustrated in FIG. 9, the second case 15 includes a body section 40, a through hole 41 for heat transfer, boss sections 42*a* to 42*d* (projecting sections), a through hole 43 for wiring, and engaging cutout sections 45*a* to 45*f*.

The body section 40 is a plate-shaped portion that covers part of the panel body 10 and the connecting wiring section 11, and includes a case-side smooth section 44 (frame-side smooth section) provided at least part of the back surface.

The case-side smooth section 44 is a portion constituting a panel-side smooth region 47 to be described later, and is substantially smooth.

The surface roughness (arithmetic average roughness) Ra according to JIS B 0601: 2013 of the case-side smooth section 44 on the back surface of the body section 40 is preferably not greater than 10 μm.

Within this range, sufficient surface contact can be achieved while reducing costs, and heat generated in the panel body 10 can be transferred to the heat-radiating mounting member 3.

Figure 8:
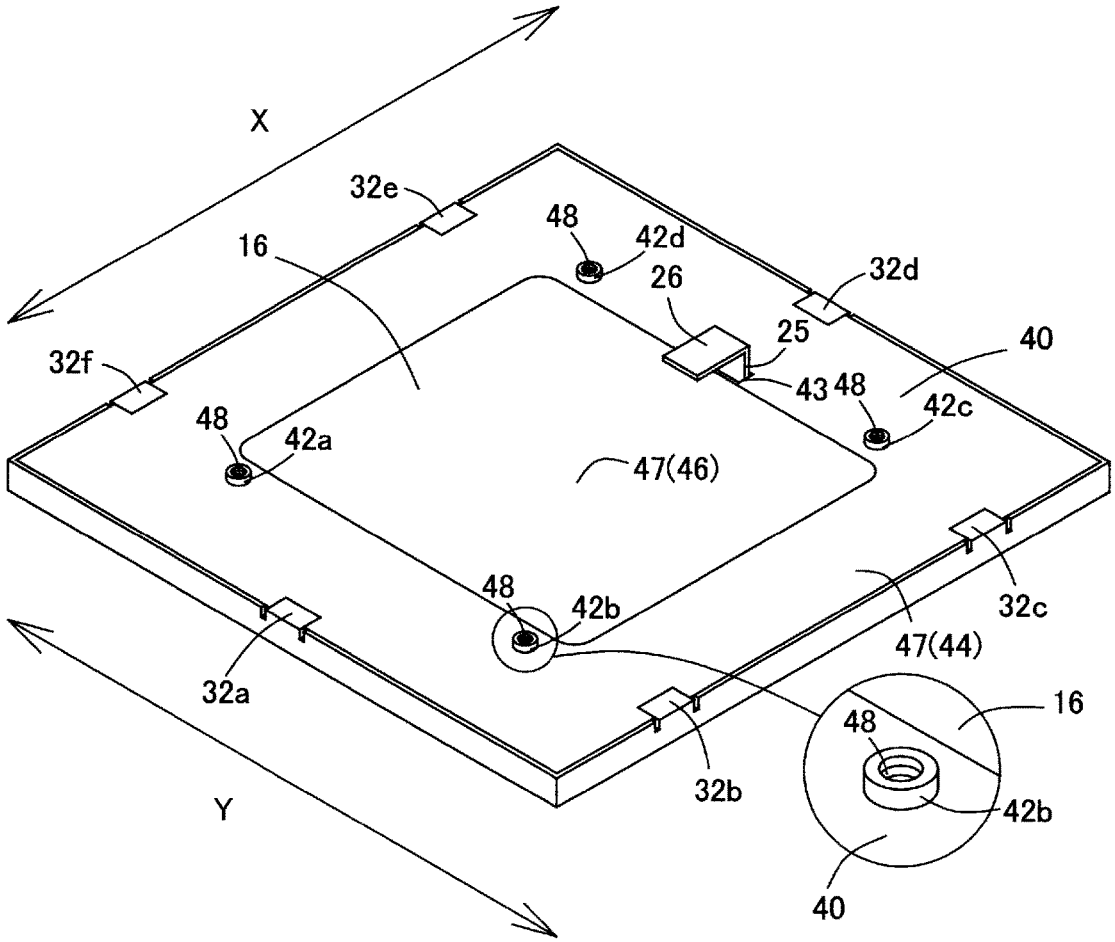
FIG. 8 is a perspective view of a planar light emitting panel illustrated in FIG. 3 seen from the back.

The through hole 41 for heat transfer is a substantially quadrangular through hole penetrating the body section 40 in the thickness direction as illustrated in FIG. 9, and is a housing hole for housing the heat transfer member 16 as illustrated in FIG. 8. The through hole 41 for heat transfer has the shape substantially identical to that of the heat transfer member 16, and can house the heat transfer member 16 therein substantially without a gap therebetween.

The through hole 41 for heat transfer has the size large enough to accommodate most part or entirety of the light emitting region 20 when the light emitting surface 9 is viewed from the front.

As illustrated in FIG. 8, the boss sections 42*a* to 42*d* are cylindrical projecting sections provided on the back surface of the panel body 10 and projecting from the body section 40 toward the heat-radiating mounting member 3.

Each of the boss sections 42*a* to 42*d* includes a fastening hole 48 that is provided at the center and can be fastened to the first fastening element 6.

The fastening hole 48 is a bottomed hole or a through hole having a depth from the distal end section toward the base end section of each of the boss sections 42*a* to 42*d* in the projecting direction. The fastening hole 48 is threaded on the inner peripheral surface, and can be engaged with a shaft section 91 (see FIG. 6A) of the first fastening element 6.

As can be seen from FIGS. 8 and 9, the through hole 43 for wiring is a through groove that penetrates the body section 40 in the thickness direction and extends in a slit shape in the lateral direction Y (width direction of the heat-radiating mounting member 3). The through hole 43 for wiring is also an insertion hole through which the second wiring section 25 of the connecting wiring section 11 can be inserted.

As illustrated in FIG. 9, the engaging cutout sections 45*a* to 45*f* are depressions that can be engaged with the engaging pieces 32*a* to 32*f* of the first case 12, respectively, are provided along respective sides of the body section 40, and have a depth in the thickness direction.

The heat transfer member 16 is made of metal, is a plate having a higher thermal conductivity than that of the body section 40 of the second case 15, and is also a blocking member that blocks the through hole 41 for heat transfer.

The heat transfer member 16 is a portion constituting the panel-side smooth region 47 to be described later, and at least the back surface thereof is smooth and constitutes a heat transfer-side smooth section 46.

In the present embodiment, both the front and back surfaces of the heat transfer member 16 are smooth, and the surface roughness (arithmetic average roughness) Ra according to JIS B 0601: 2013 of the back surface is preferably not greater than 10 μm.

Here, the positional relationship of each portion of the planar light emitting panel 2 will be described.

As illustrated in FIG. 9, the front surface side (the light emitting surface 9 side) of the planar light emitting panel 2 is covered with the first case 12, and the back surface side (heat-radiating mounting member 3 side) of the planar light emitting panel 2 is covered with the second case 15. The engaging pieces 32*a* to 32*f* of the first case 12 are engaged with the engaging cutout sections 45*a* to 45*f* of the second case 15, respectively.

As illustrated in FIG. 8, the boss sections 42*a* to 42*d* are located outside in the longitudinal direction X of the heat transfer member 16 (length direction of the heat-radiating mounting member 3), and are provided near the four corners of the heat transfer member 16. That is, the boss sections 42*a*, 42*b* face the boss sections 42*c*, 42*d* across the heat transfer member 16 in the longitudinal direction X, and the boss sections 42*a*, 42*d* face the boss sections 42*b*, 42*c* across the heat transfer member 16 in the lateral direction Y.

The through hole 43 for wiring is located between the boss sections 42*c*, 42*d* in the lateral direction Y when viewed from the back.

As illustrated in FIG. 8, the heat transfer member 16 is fitted into the through hole 41 for heat transfer of the body section 40, and the back surface of the heat transfer member 16 and the back surface of the body section 40 form an identical plane and are flush with each other. That is, on the back surface of the planar light emitting panel 2, the case-side smooth section 44 and the heat transfer-side smooth section 46 form the panel-side smooth region 47 that does not substantially include a protrusion.

The panel-side smooth region 47 is located on the projection surface in the thickness direction of a soaking member incorporated in the panel body 10. That is, the panel-side smooth region 47 is provided at a location that overlaps with the soaking sheet 38 (see FIG. 6B) incorporated in the panel body 10 when viewed from the back. The panel-side smooth region 47 occupies the area of not less than 50 percent of the area of the light emitting region 20 in plan view of the light emitting surface 9.

The surface roughness (arithmetic average roughness) Ra of the panel-side smooth region 47 is preferably not greater than 10 μm.

Within this range, sufficient surface contact can be achieved while reducing costs, and heat generated in the panel body 10 can be transferred to the heat-radiating mounting member 3.

The heat-radiating mounting member 3 is a heat radiating member that soaks and radiates heat generated in the planar light emitting panel 2. As illustrated in FIG. 2, the heat-radiating mounting member 3 is also a mounting member that holds one or a plurality of planar light emitting panels 2 and is to be mounted on the mounted surface 200.

The heat-radiating mounting member 3 is made of material having high thermal conductivity, and specifically, is a metal member. The heat-radiating mounting member 3 of the present embodiment is made of a galvanized steel plate, and specifically, is made of SECC according to JIS G 3313: 2010. Therefore, it is possible to configure the dust-free illumination apparatus that is inexpensive and excellent in appearance, and substantially does not contaminate the food item 201 when the illumination apparatus is brought into contact with the food item 201.

As illustrated in FIGS. 3, 4, the heat-radiating mounting member 3 includes a body section 50, a control board 51 (feed element), a power input board 52 (feed element), a wiring fixing member 53, an internal wiring member 54, and an external wiring member 55.

The body section 50 is a member having a "U" cross-sectional shape and an opening facing upward, and includes a body plate-section 60, and rising wall sections 61, 62.

The body plate-section 60 is a long plate-shaped portion having a width and extending in a predetermined direction (length direction X). The body plate-section 60 includes a through hole 64 for feeding power, a through hole 65 for fixing a panel, a through hole 66 for mounting, and a through hole 67 for fixing wiring.

The body plate-section 60 is a member whose front surface constitutes a placement surface on which the planar light emitting panel 2 is placed and mounted, and whose back surface constitutes a power feeding surface on which the feed element such as the control board 51 is installed.

A mounting-side smooth region 68 is formed on at least the front surface (surface opposite to the mounted surface 200) of the body plate-section 60.

The mounting-side smooth region 68 is a region that constitutes the placement surface, and is a substantially smooth region.

The surface roughness Rs of the mounting-side smooth region 68 is preferably not greater than 10 μm. The surface roughness (arithmetic average roughness) Ra of the mounting-side smooth region 68 is preferably not greater than 10 μm.

Within this range, sufficient surface contact can be achieved while reducing costs, and heat generated in the panel body 10 can be transferred to the heat-radiating mounting member 3.

As illustrated in FIGS. 3 and 4, the through hole 64 for feeding power is a slit-shaped through groove that penetrates the body plate-section 60 in the thickness direction and extends in the width direction Y, and forms a penetrating opening extending from the placement surface to the power feeding surface. As illustrated in FIG. 6B, part of the connecting wiring section 11 of the planar light emitting panel 2 can be inserted into the through hole 64 for feeding power.

As illustrated in FIGS. 3 and 4, the through hole 65 for fixing the panel is a through hole penetrating the body plate-section 60 in the thickness direction, and the shaft section 91 of the first fastening element 6 can be inserted therethrough. As illustrated in FIG. 6A, the through holes 65 for fixing the panel can house the boss sections 42*a* to 42*d* of the second case 15, respectively.

As illustrated in FIG. 3, the through hole 66 for mounting is a through hole penetrating the body plate-section 60 in the thickness direction, and the cylindrical section 95 of the second fastening element 7 can be inserted therethrough.

As illustrated in FIG. 4, the through hole 67 for fixing the wiring is a through hole penetrating the body plate-section 60 in the thickness direction, and the shaft section 99 of the third fastening element 8 can be inserted therethrough.

As illustrated in FIG. 4, the rising wall sections 61, 62 are wall sections that are bent from both ends in the width direction Y of the body plate-section 60 toward the mounted surface 200. That is, the rising wall sections 61, 62 rise with respect to the body plate-section 60 and are reinforcing walls that reinforce the strength of the body plate-section 60 in the thickness direction.

The control board 51 is a board that controls output to the planar light emitting panel 2, and is a board that performs dimming control of the planar light emitting panel 2.

The power input board 52 is a board that converts a constant voltage into a constant current, and a board that supplies the constant current to the planar light emitting panel 2 side.

The wiring fixing member 53 is a fixing member that positions and fixes the external wiring member 55 as illustrated in FIG. 4, and is also a regulating member that regulates movement of the external wiring member 55 in the length direction X.

Figure 10:
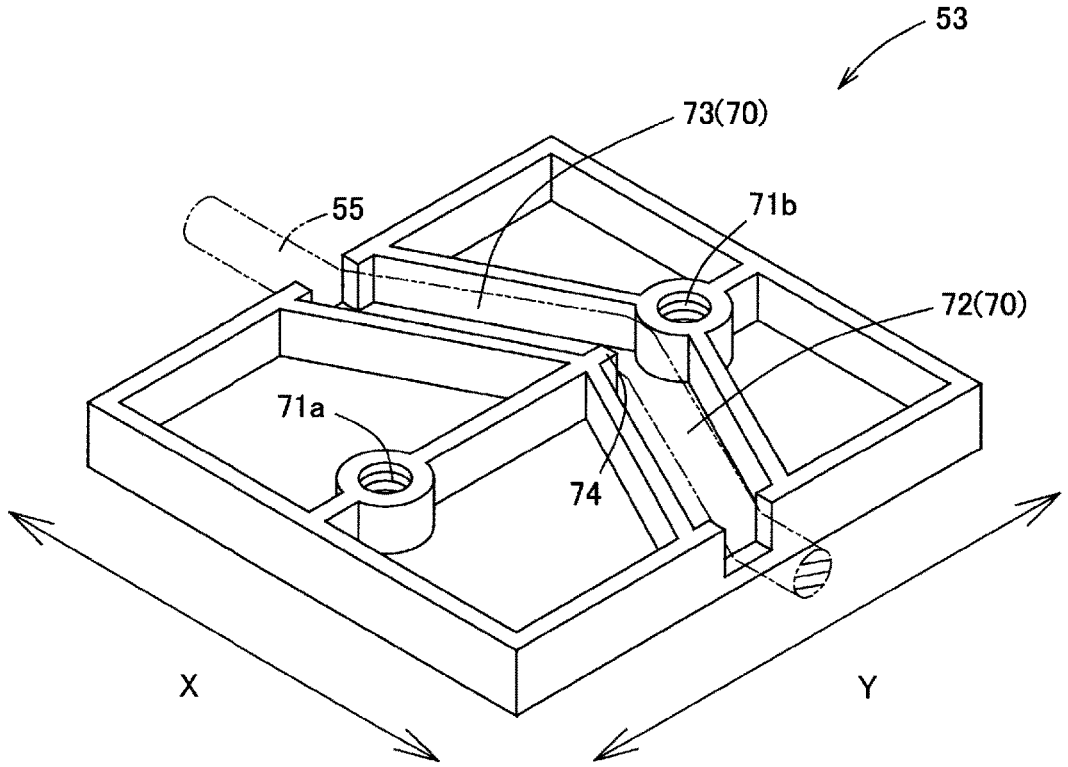
FIG. 10 is a perspective view of a wiring fixing member illustrated in FIG. 4.

As illustrated in FIG. 10, the wiring fixing member 53 includes a bent groove 70 and fixing holes 71*a*, 71*b*.

The bent groove 70 is a groove that houses part of the external wiring member 55 in a bent state, has a depth in the thickness direction, is bent in a dogleg shape, and extends. That is, as illustrated in FIG. 10, the bent groove 70 includes a first groove section 72 and a second groove section 73 extending in a direction intersecting the first groove section 72, and a locking piece 74 is provided at the boundary between the first groove section 72 and the second groove section 73.

Each of the fixing holes 71*a*, 71*b* is a bottomed hole or a through hole for fixing the wiring fixing member 53 to the body plate-section 60 by the third fastening element 8, is threaded inside, and can be engaged with the shaft section 99 of the third fastening element 8.

Figure 5B:
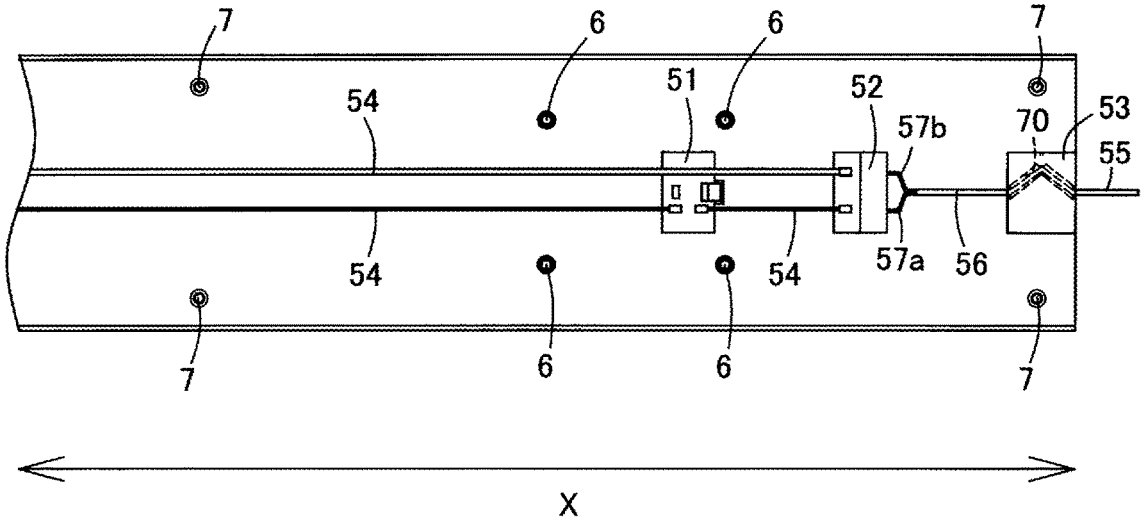
Figure 11:
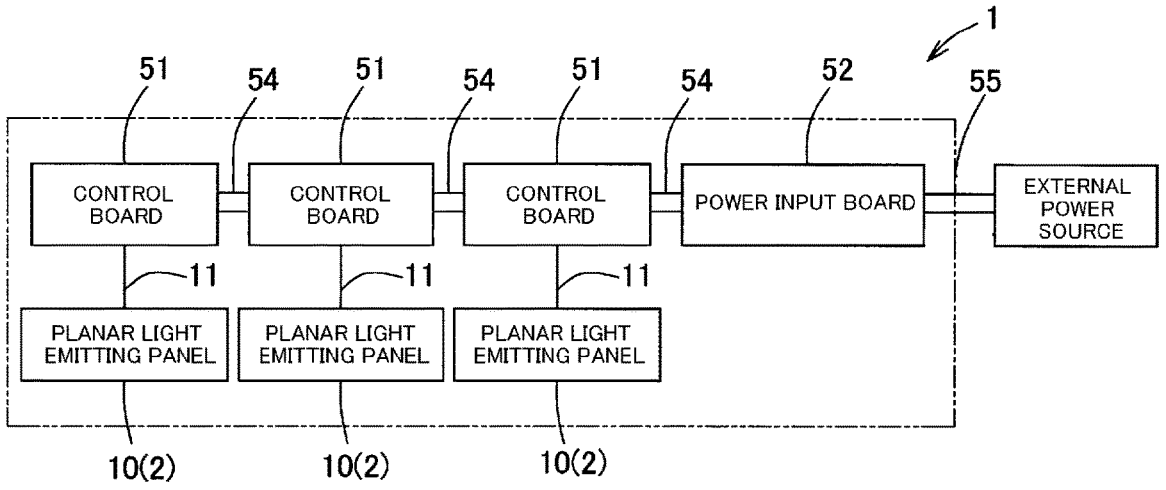
FIG. 11 is an electric circuit diagram of the illumination apparatus illustrated in FIG. 2.

As illustrated in FIGS. 5B and 11, the internal wiring member 54 is connecting wiring that electrically connects the control boards 51, 51 or the control board 51 and the power input board 52 adjacent to each other in the length direction X.

As illustrated in FIG. 11, the external wiring member 55 is a power feeding wiring that electrically connects the power input board 52 to an external power source, and is a linear wiring that can be bent as illustrated in FIG. 4. The external wiring member 55 includes a body section 56 and branch sections 57*a*, 57*b*.

The branch sections 57*a*, 57*b* are wiring sections that are located downstream of the body section 56 in the power supply direction and branch from the body section 56.

Figure 12:
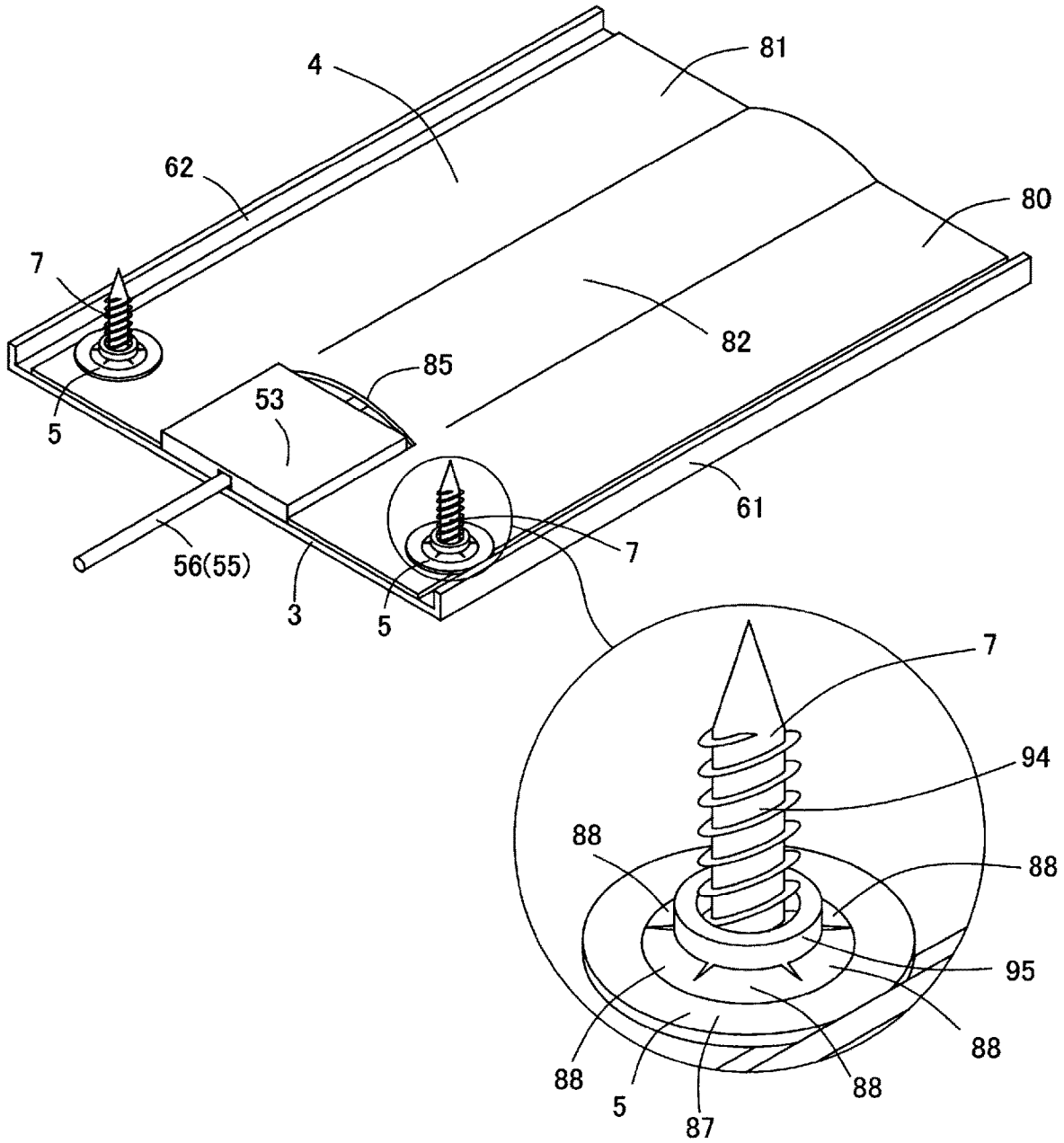
FIG. 12 is a perspective view of a main part of the illumination apparatus illustrated in FIG. 2, viewed from a direction different from that in FIG. 2.

As illustrated in FIG. 12, the cover member 4 is a protective cover that protects the control board 51, the power input board 52, and the internal wiring member 54, and is a long member having a width and extending in a predetermined direction (length direction X).

As illustrated in FIGS. 3 and 12, the cover member 4 includes base sections 80, 81 and a housing section 82.

As illustrated in FIG. 3, each of the base sections 80, 81 includes a cover-side through hole 83 penetrating the base section 80, 81 in the thickness direction.

The cover-side through hole 83 is an insertion hole into which the cylindrical section 95 of the second fastening element 7 can be inserted.

Figure 7:
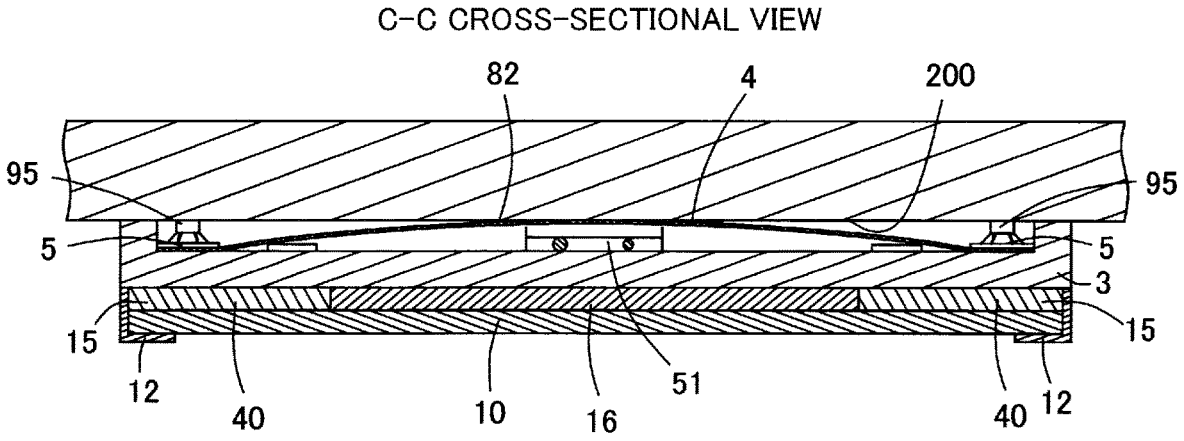
FIG. 7 is a C-C cross-sectional view of the illumination apparatus illustrated in FIG. 5A.

As illustrated in FIG. 7, the housing section 82 is a portion that is raised with respect to the base sections 80, 81 and curved in an arc shape. The housing section 82 houses the control board 51, the power input board 52, and the internal wiring member 54 so as to be able to protect the control board 51, the power input board 52, and the internal wiring member 54 from outside.

As illustrated in FIG. 3, the base sections 80, 81 include a cutout section 85 which is provided at an end in the longitudinal direction (length direction X) and into which the wiring fixing member 53 can be inserted.

As illustrated in FIG. 12, the push nut 5 is a retaining ring for fitting and fixing the cylindrical section 95 of the second fastening element 7 therein, and includes an annular base section 87 and a plurality of claw sections 88 extending from the base section 87 toward the center. When the cylindrical section 95 of the second fastening element 7 is inserted into the push nut 5, the claw section 88 bites into the outer peripheral surface of the cylindrical section 95 of the second fastening element 7, and therefore it is possible to prevent the cylindrical section 95 of the second fastening element 7 from falling off.

The first fastening element 6 is a temporary fastening element for mounting the planar light emitting panel 2 on the heat-radiating mounting member 3, and is specifically a screw. That is, as illustrated in FIG. 6A, the first fastening element 6 has a head section 90 and the shaft section 91. The shaft section 91 is engaged with the fastening hole 48 of one of the boss sections 42*a* to 42*d* of the planar light emitting panel 2 so that the first fastening element 6 can be fastened with the fastening hole 48.

The head section 90 is larger than the opening area of the through hole 65 for fixing the panel.

The second fastening element 7 is a fastening element for mounting the heat-radiating mounting member 3 on the mounted surface 200.

As illustrated in the enlarged view of FIG. 3, the second fastening element 7 has a head section 93, a shaft section 94, and a cylindrical section 95. The cylindrical section 95 surrounds the periphery of the shaft section 94. The portion of the shaft section 94 exposed from the cylindrical section 95 can be engaged with the mounted surface 200.

The third fastening element 8 is a temporary fastening element for mounting the wiring fixing member 53 on the heat-radiating mounting member 3, and is specifically a screw. That is, as illustrated in FIG. 4, the third fastening element 8 has a head section 98 and the shaft section 99. The shaft section 99 can be engaged with one of the fixing holes 71*a*, 71*b* (see FIG. 10) of the wiring fixing member 53.

Subsequently, the positional relationship of each portion of the illumination apparatus 1 according to the first embodiment of the present invention will be described.

As illustrated in FIG. 2, in the illumination apparatus 1 of the present embodiment, the three planar light emitting panels 2 are mounted on and held by the heat-radiating mounting member 3, and are disposed side by side on a straight line at predetermined intervals in the length direction X. The size in the length direction X (longitudinal direction X) of the planar light emitting panel 2 of the present embodiment is not greater than ⅓ of the length of the heat-radiating mounting member 3 in the length direction X.

The shortest distance D1 between the adjacent planar light emitting panels 2, 2 in the length direction X is preferably greater than the length D2 of the planar light emitting panel 2.

As illustrated in FIG. 5A, in the illumination apparatus 1, when the light emitting surface 9 is viewed from the front, the planar light emitting panel 2 overlaps with the heat-radiating mounting member 3, and is within the heat-radiating mounting member 3 in the width direction Y.

As illustrated in FIG. 6B, in the illumination apparatus 1, the through hole 43 for wiring of the second case 15 and the through hole 64 for feeding power of the body plate-section 60 form one communication hole, and the second wiring section 25 passes through the communication hole. With respect to the second case 15 and the body plate-section 60, the first wiring section 24 is located on the light emitting surface 9 side, and the third wiring section 26 is located on the back surface side. That is, the connecting wiring section 11 passes through the through hole 64 for feeding power from the placement surface side and reaches the power feeding surface side in the body plate-section 60.

As illustrated in FIG. 6A, in the planar light emitting panel 2, the boss sections 42*a* to 42*d* are inserted into the through holes 65 for fixing the panel of the body plate-section 60. The first fastening elements 6 are inserted from the mounted surface 200 side toward the planar light emitting panel 2 side, and the shaft sections 91 are engaged with the fastening holes 48 of the boss sections 42*a* to 42*d* of the planar light emitting panel 2.

In the illumination apparatus 1, the through hole 66 for mounting of the body plate-section 60 and the cover-side through hole 83 of one of the base sections 80, 81 form one communication hole. As illustrated in FIG. 3, the second fastening element 7 is inserted from the planar light emitting panel 2 side toward the mounted surface 200 side, the shaft section 94 is inserted into the cylindrical section 95, and the cylindrical section 95 passes through the communication hole and is inserted into the push nut 5. That is, the cylindrical section 95 of the second fastening element 7 is engaged with the claw section 88 of the push nut 5 as illustrated in FIG. 12. The distal end section of the shaft section 94 protrudes from the cylindrical section 95 and is inserted into the mounted surface 200.

As illustrated in FIG. 4, the third fastening elements 8 are inserted from the planar light emitting panel 2 side toward the mounted surface 200 side, and the shaft sections 99 pass through the through holes 67 for fixing wiring, and are engaged with the fixing holes 71*a*, 71*b*.

The control board 51 and the power input board 52 are provided on the surface of the body plate-section 60 opposite to the planar light emitting panel 2. As illustrated in FIG. 5, each control board 51 is disposed at a location overlapping with each planar light emitting panel 2 when the light emitting surface 9 is viewed from the front, and the power input board 52 is disposed outside the planar light emitting panel 2 in the length direction X.

Each control board 51 and the power input board 52 are connected by the internal wiring member 54, and the power input board 52 can be connected to an external power source by the external wiring member 55.

As illustrated in FIG. 11, in the illumination apparatus 1, an external power source is connected to the power input board 52 via the external wiring member 55, and the power input board 52 is connected to each control board 51 via the internal wiring member 54. Each control board 51 is connected to each panel body 10 via the connecting wiring section 11. Adjacent control boards 51 are connected by the internal wiring member 54. That is, in the illumination apparatus 1, in each planar light emitting panel 2, a power feeding path is formed from the external power source to the panel body 10 via the external wiring member 55 and the control board 51.

when one planar light emitting panel 2 is focused on, as illustrated in FIG. 6, the heat transfer member 16 is interposed between the panel body 10 of the planar light emitting panel 2 and the body plate-section 60 of the heat-radiating mounting member 3. One of the principal surfaces of the heat transfer member 16 in surface contact and close contact with the soaking sheet 38 of the panel body 10 directly or via another film, and the other principal surface of the heat transfer member is in surface contact and close contact with the body plate-section 60.

The panel-side smooth region 47 of the planar light emitting panel 2 illustrated in FIG. 8 is brought into contact and in surface contact with the mounting-side smooth region 68 of the body plate-section 60 of the heat-radiating mounting member 3 as illustrated in FIG. 3. That is, the panel-side smooth region 47 and the mounting-side smooth region 68 are in surface contact with each other in the area of not less than 50 percent of the area of the light emitting region 20 in plan view of the light emitting surface 9.

The panel-side smooth region 47 and the mounting-side smooth region 68 are preferably in surface contact with each other in the area of not less than 70 percent of the area of the light emitting region 20, and are more preferably in surface contact with each other in the area of not less than 80 percent of the area of the light emitting region 20. In the illumination apparatus 1 of the present embodiment, each of the panel-side smooth region 47 and the mounting-side smooth region 68 is greater than the light emitting region 20, and the panel-side smooth region 47 and the mounting-side smooth region 68 are in surface contact with each other in the area of not less than the area of the light emitting region 20.

In the illumination apparatus 1 of the present embodiment, the maximum thickness of the portion where the planar light emitting panel 2 is mounted on the heat-radiating mounting member 3 is preferably not greater than 20 mm, and more preferably not greater than 10 mm. If the maximum thickness is within this range, there is few restrictions on an installation place and it is easy to install the illumination apparatus in an existing space.

According to the illumination apparatus 1 of the present embodiment, even if the planar light emitting panel 2 generates heat during lighting, the heat is conducted to the heat-radiating mounting member 3 via the panel-side smooth region 47, soaked, and radiated. Therefore, the planar light emitting panel 2 hardly gets hot.

Even if excessive current flows to the control board 51 or the power input board 52 which is the feed element due to some influence and generates heat, since the control board 51 or the power input board 52 is placed on the heat-radiating mounting member 3, the heat-radiating mounting member 3 soaks and radiates the heat. Therefore, the control board 51 and the power input board 52 hardly become hot.

As described above, since the entire illumination apparatus 1 does not easily become hot, the food item 201 is hardly dried by radiant heat of the planar light emitting panel 2.

According to the illumination apparatus 1 of the present embodiment, since the feed element such as the control board 51 faces the planar light emitting panel 2 with the body plate-section 60 interposed therebetween, the feed element is isolated from the planar light emitting panel 2 by the body plate-section 60. Therefore, even if the feed element generates heat, a temperature rise of the light emitting surface 9 can be suppressed.

According to the illumination apparatus 1 of the present embodiment, the high color-rendering organic EL tile is used for the panel body 10. Therefore, it is possible to radiate light close to natural light and illuminate the food item 201 so that the food item 201 looks delicious.

According to the illumination apparatus 1 of the present embodiment, the body section 50 of the heat-radiating mounting member 3 includes the rising wall sections 61 and 62 folded from the ends of the body plate-section 60 in the width direction Y. Therefore, strength can be improved with low costs.

According to the illumination apparatus 1 of the present embodiment, the cover member 4 protects the control board 51, the power input board 52, and the internal wiring member 54 of the heat-radiating mounting member 3. Therefore, the control board 51, the power input board 52, and the internal wiring member 54 are hardly seen, and the appearance can be improved. In addition, an electric shock caused by contact with the control board 51, the power input board 52, and the internal wiring member 54 is prevented, and reliability can be improved.

According to the illumination apparatus 1 of the present embodiment, a flexible wiring board is used as the connecting wiring section 11. Therefore, the entire thickness of the illumination apparatus 1 can be reduced, and assembly is facilitated.

According to the illumination apparatus 1 of the present embodiment, since the plurality of planar light emitting panels 2 is mounted on a straight line on the placement surface of the heat-radiating mounting member 3, there are few restrictions on the width, and the illumination apparatus 1 can be easily and inexpensively mounted on the mounted surface 200 under the shelf.

Figure 13:
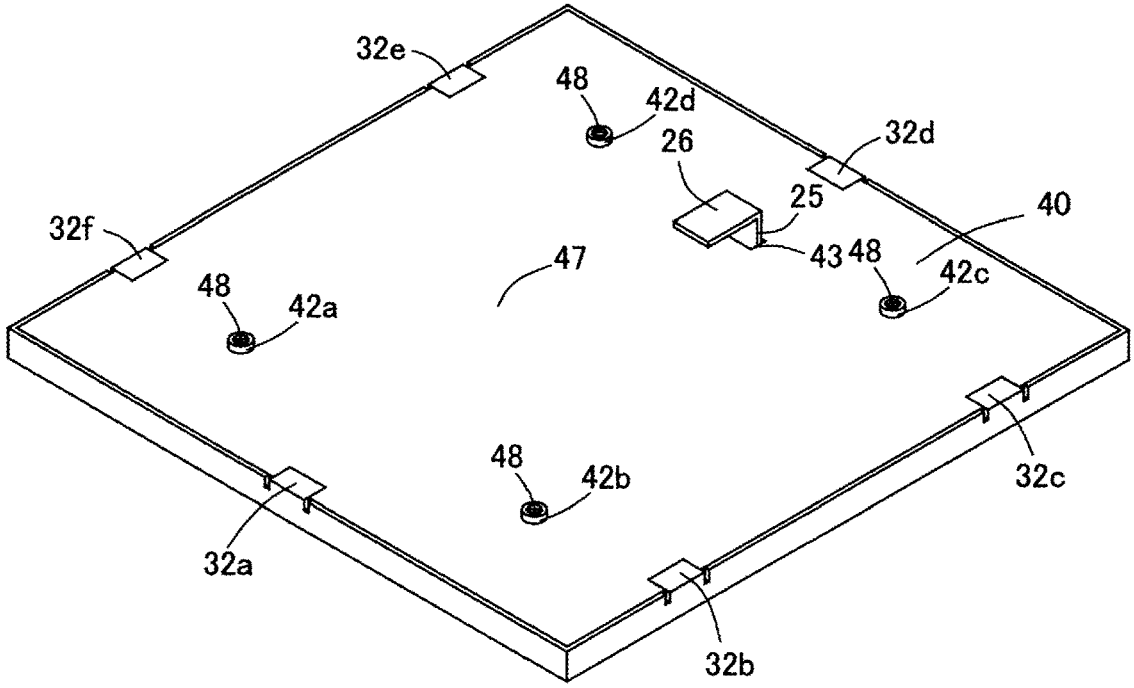
FIG. 13 is a perspective view of a planar light emitting panel according to another embodiment of the present invention, seen from the back.

In the above-described embodiment, the heat transfer member 16 is inserted into the through hole 41 for heat transfer of the body section 40, and the panel-side smooth region 47 is provided by the body section 40 and the heat transfer member 16. However, the present invention is not limited to this. As illustrated in FIG. 13, the panel-side smooth region 47 may be formed only of the body section 40 without providing the through hole 41 for heat transfer in the body section 40. That is, the heat transfer member 16 is not necessarily provided.

In the above-described embodiment, the power input board 52 is provided on the back surface side of the body plate-section 60; however, the present invention is not limited to this. The power input board 52 may be provided outside the heat-radiating mounting member 3.

Figure 14:
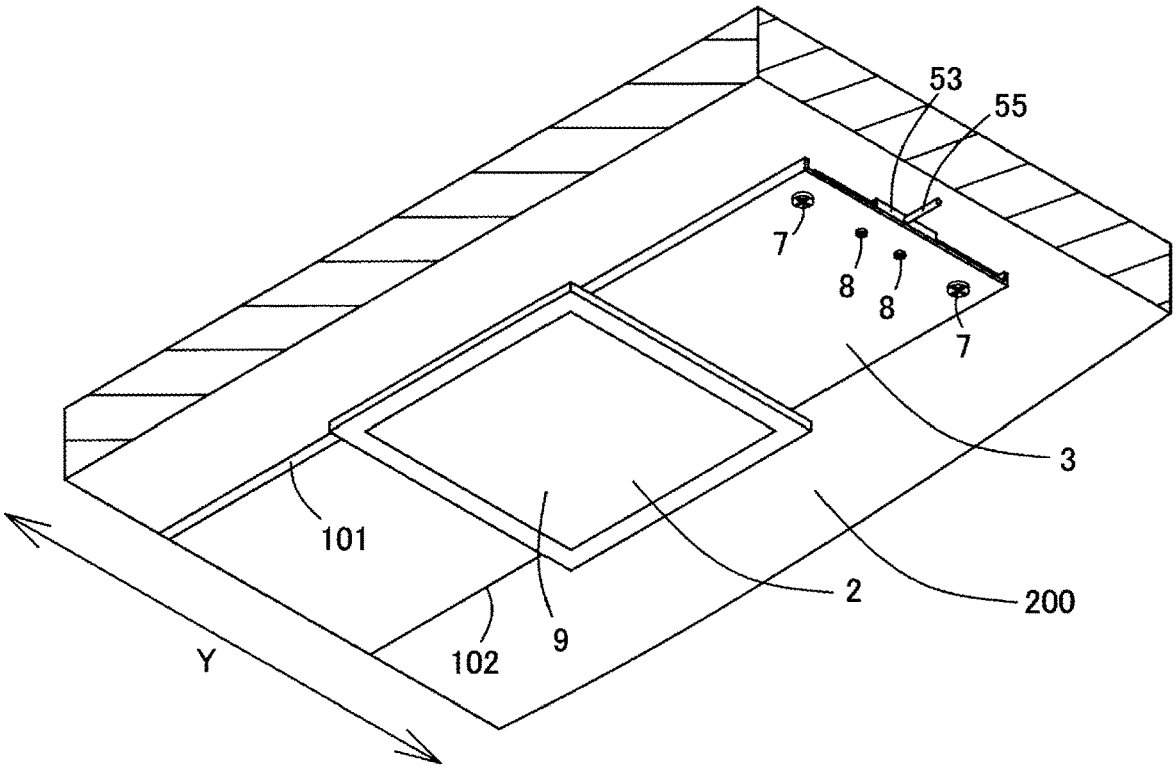
FIG. 14 is a perspective view illustrating an illumination apparatus according to another embodiment of the present invention.

In the above-described embodiment, the planar light emitting panel 2 has a size that can be accommodated in the heat-radiating mounting member 3 when the light emitting surface 9 is viewed from the front; however, the present invention is not limited to this. As illustrated in FIG. 14, the planar light emitting panel 2 has a size of overlapping with two sides 101, 102 facing each other in the width direction Y and protruding outside the two sides 101, 102, when the light emitting surface 9 is viewed from the front. That is, the ends of the planar light emitting panel 2 in the width direction Y may protrude from the heat-radiating mounting member 3 in the width direction Y. In this case, the size of the planar light emitting panel 2 in the width direction Y is preferably greater than the length of the heat-radiating mounting member 3 in the width direction Y. As a result, the two sides 101,102 facing each other in the width direction Y of the body plate-section 60 of the heat-radiating mounting member 3 are hidden by the planar light emitting panel 2, and the heat-radiating mounting member 3 is more hardly seen and the appearance becomes good.

In the above-described embodiment, the mounting-side smooth region 68 is formed on the entire front surface of the body plate-section 60 of the heat-radiating mounting member 3; however, the present invention is not limited to this. The mounting-side smooth region 68 may be formed on part of the front surface. For example, the mounting-side smooth region 68 may be individually provided at a location corresponding to the planar light emitting panel 2. As a result, it is possible to ensure heat transfer properties similar to that in a case where the mounting-side smooth region 68 is provided on the entire front surface.

In the above-described embodiment, the case where the illumination apparatus 1 is mounted on the display shelf displaying the food item 201 has been described; however, the present invention is not limited to this. The illumination apparatus 1 may be mounted on a display shelf that displays a cultural item such as a scroll or a cultural asset.

In the above-described embodiment, the three planar light emitting panel 2 is mounted on the one heat-radiating mounting member 3; however, the present invention is not limited to this. One or two planar light emitting panels 2 may be mounted on one heat-radiating mounting member 3, or four or more planar light emitting panels 2 may be mounted on one heat-radiating mounting member 3.

In the above-described embodiment, the illumination apparatus 1 is mounted on the mounted surface 200 constituting the top surface section of the display shelf; however, the present invention is not limited to this. The mounting location of the illumination apparatus 1 is not particularly limited. The illumination apparatus 1 may be mounted on a bottom surface section or a side surface section which faces the display space of the display shelf. In addition, the illumination apparatus 1 may be mounted on an object other than the display shelf. Similarly to a normal illumination apparatus, the illumination apparatus 1 may be mounted on a fixed structure such as a ceiling, a wall, or a floor.

In the above-described embodiment, the light emitting surface 9 is directed downward; however, the present invention is not limited to this. The direction of the light emitting surface 9 is not particularly limited. For example, direct illumination is possible by directing the light emitting surface 9 in the direction facing the food item 201, or indirect illumination is possible by directing the light emitting surface 9 toward the inner wall of the shelf and using reflection on the inner wall.

In the above-described embodiment, the planar light emitting panels 2 are aligned on a straight line in the length direction X on the heat-radiating mounting member 3; however, the present invention is not limited to this. The respective planar light emitting panels 2 may be suitably shifted from each other in the width direction Y.

In the above described embodiments, constituents can be freely replaced or added between the embodiments as long as they are included in the technical scope of the present invention.

EXAMPLES

Hereinafter, the present invention will be described specifically by showing examples. Note that the present invention is not limited to the following examples, and can be appropriately changed in the range which does not change the gist thereof for the embodiment.

Example 1

In Example 1, as a panel body 10 of a planar light emitting panel 2, an organic EL tile having an outer dimension of 90 mm×90 mm was used. In the organic EL tile, the size of a light emitting region was 80 mm×80 mm, and a graphite sheet was exposed on the back surface. An organic EL panel was formed by bringing an aluminum plate (50 mm×60 mm) into surface contact with the graphite sheet on the back surface of the organic EL tile. Furthermore, the aluminum plate of the organic EL panel was brought into surface contact with a galvanized steel plate (thickness 1.0 mm) which is a heat-radiating mounting member to form an illumination apparatus.

Figure 15A:
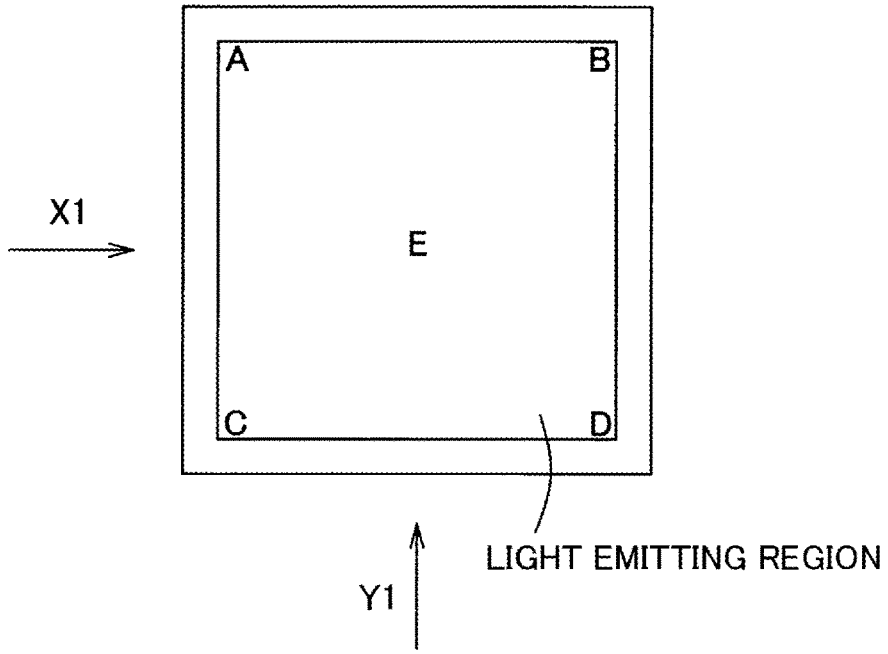
Figure 15B:
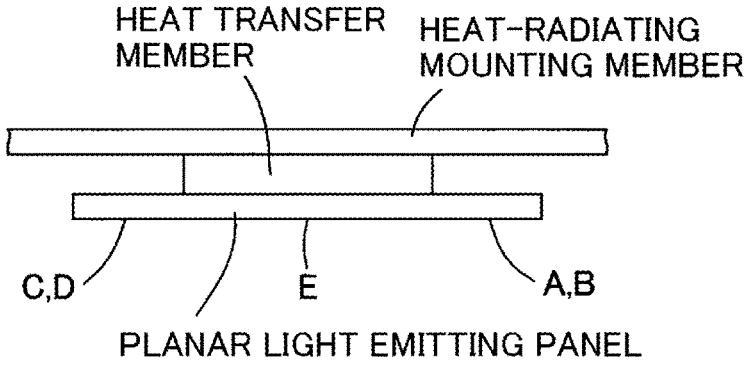
Figure 15C:
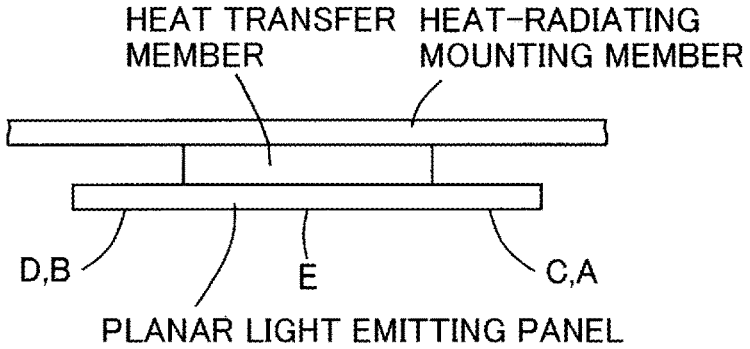

In order to measure a temperature rise, 300 mm×300 mm×900 mm wooden measuring box with open sides was used. The illumination apparatus was fixed to the inner wall surface of the top surface section of the measuring box so that the light emitting surface was directed downward. A constant current of 220 mA was supplied to turn on the illumination apparatus. Then, temperature at 5 points (A to E) illustrated in FIG. 15 on the light emitting surface after 30 minutes was measured with a thermocouple. That is, the temperature at the four corners and the center of the light emitting region was measured.

Example 2

In Example 2, an illumination apparatus was formed in a similar manner as the illumination apparatus in Example 1 except that instead of the aluminum plate, a plastic plate of the same size was used. Temperature rise measurement to the illumination apparatus was performed in the same manner as in Example 1.

Comparative Example 1

In Comparative Example 1, an illumination apparatus was formed in the similar manner as in the illumination apparatus of Example 1, except that a heat-radiating mounting member was mounted without bringing a graphite sheet of an organic EL tile into contact with the heat-radiating mounting member.

A temperature rise measurement was performed for the illumination apparatus thus obtained in the similar manner as in Example 1.

Comparative Example 2

In Comparative Example 2, an organic EL tile similar to that in Example 1 was directly fixed to a top surface section, and temperature rise measurement was performed in the similar manner as in Example 1.

Table 1 indicates the results of temperature rise measurement in Examples 1, 2 and Comparative Examples 1, 2. Note that each numerical value is a value obtained by converting the numerical value of the temperature at the time of measurement into the numerical value at 25 degrees Celsius.

TABLE 1

| | Heat Transfer Member | Average Temperature (° C.) at Five Measurement Points (A to E) |
|---|---|---|
| Example 1 | Aluminum Plate | 30.75 |
| Example 2 | Polycarbonate Plate | 31.04 |
| Comparative Example 1 | None | 31.39 |
| Comparative Example 2 | Organic EL Tile Alone | 32.35 |

From the results of Table 1, in each of Examples 1 and 2 and Comparative Example 1 in which the organic EL tile was fixed to the top surface section through the heat-radiating mounting member, the average temperature was lower than that in Comparative Example 2 in which the organic EL tile was directly fixed to the top surface section. From this, it was found that the temperature of the light emitting surface can be suppressed by providing the heat-radiating mounting member.

In addition, from the results of Table 1, the average temperature in each of Examples 1, 2 in which the organic EL tile graphite sheet was brought into surface contact with the heat-radiating mounting member through the heat transfer member was lower than the average temperature in Comparative Example 1 in which the graphite sheet of the organic EL tile was not brought into surface contact with the heat-radiating mounting member. From this, it can be considered that heat of the light emitting surface was brought into surface contact with the heat-radiating mounting member, and was transferred on the surface, and was soaked and radiated by the heat-radiating mounting member.

As described above, it was found that the temperature rise of the light emitting surface 9 can be further suppressed by bringing the organic EL panel into surface contact with the heat-radiating mounting member 3 than in the case of using the organic EL tile alone.

EXPLANATION OF REFERENCE CHARACTERS

1: Illumination apparatus
2: Planar light emitting panel
3: Heat-radiating mounting member
4: Cover member
5: Push nut
6: First fastening element
7: Second fastening element
9: Light emitting surface
10: Panel body
11: Connecting wiring section
15: Second case (Back-surface supporting case)
16: Heat transfer member
20: Light emitting region
40: Body section
41: Through hole for heat transfer
42*a* to 42*d*: Boss section (Projecting section)
47: Panel-side smooth region
48: Fastening hole
50: Body section
51: Control board (Feed element)
52: Power input board (Feed element)
53: Wiring fixing member
54: Internal wiring member
55: External wiring member
60: Body plate-section
64: Through hole for feeding power
65: Through hole for fixing panel
68: Mounting-side smooth region
70: Bent groove
74: Locking piece
87: Base section
88: Claw section
94: Shaft section
95: Cylindrical section
200: Mounted surface (Mounted section)

The invention claimed is:

1. An illumination apparatus comprising:

a planar light emitting panel; and a heat-radiating mounting member having a body plate-section, wherein the heat-radiating mounting member is configured to mount the planar light emitting panel on a mounted section, wherein the body plate-section comprises:

a first through hole for feeding power that penetrates the body plate-section in a thickness direction; and a mounting-side smooth region that includes substantially no protrusion, wherein the planar light emitting panel comprises: a panel body; and a connecting wiring section, wherein the connecting wiring section is configured to electrically connect the panel body to an external power source, the connecting wiring section traveling from a panel-body side of the body plate-section to an opposite side of the body plate-section through the first through hole, wherein the planar light emitting panel comprises:

a front surface that is constituted by a light emitting surface including a light emitting region that emits light during lighting; and a back surface that includes a panel-side smooth region including substantially no protrusion, and wherein the mounting-side smooth region and the panel-side smooth region are in surface contact with each other in an area not less than 50 percent of the light emitting region in plan view of the light emitting surface.

2. An illumination apparatus comprising:

a planar light emitting panel; and a heat-radiating mounting member having a body plate-section and a feed element, wherein the heat-radiating mounting member is configured to support and mount the planar light emitting panel on a mounted section, wherein the body plate-section comprises:

a first through hole for feeding power that penetrates the body plate-section in a thickness direction; and a mounting-side smooth region that includes substantially no protrusion, wherein the feed element is located to an opposite side to the planar light emitting panel with respect to the body plate-section and is electrically connected to an external power source, wherein the planar light emitting panel comprises: a panel body; and a connecting wiring section, wherein the connecting wiring section is configured to connect the panel body to the feed element through the first through hole, wherein the planar light emitting panel comprises:

a front surface that is constituted by a light emitting surface including a light emitting region that emits light during lighting; and a back surface that includes a panel-side smooth region including substantially no protrusion, and wherein the mounting-side smooth region and the panel-side smooth region are in surface contact with each other in an area not less than 50 percent of the light emitting region in plan view of the light emitting surface.

3. The illumination apparatus according to claim 1 further comprising at least two of the planar light emitting panels, wherein the heat-radiating mounting member holds the at least two of the planar light emitting panels at a predetermined interval, and wherein a shortest distance between the at least two of the planar light emitting panels is greater than a length of the planar light emitting panels.

4. The illumination apparatus according to claim 1 further comprising a plurality of the planar light emitting panels, wherein the heat-radiating mounting member is long-sized, thereby holding the plurality of the planar light emitting panels linearly side by side in a longitudinal direction.

5. The illumination apparatus according to claim 1, wherein the body plate-section is made of a galvanized steel plate.

6. The illumination apparatus according to claim 1, wherein a maximum thickness of a portion where the planar light emitting panel is mounted on the heat-radiating mounting member is not greater than 20 mm.

7. The illumination apparatus according to claim 1, wherein the planar light emitting panel includes a back-surface supporting case that supports a back surface side of the panel body, the back-surface supporting case having a second through hole for heat transfer, the second through hole exposing part of the back surface of the panel body, and wherein the illumination apparatus further comprises a heat transfer member that blocks most part of the second through hole, the heat transfer member being constituted by a metal plate, the heat transfer member including:

one principal surface in surface contact with the panel body; and an other principal surface in surface contact with the body plate-section.

8. The illumination apparatus according to claim 1, wherein the planar light emitting panel comprises a back-surface supporting case that supports a back surface side of the panel body, the back-surface supporting case including a body section and a projecting section that projects from the body section, the projecting section including a fastening hole that has a depth from a distal end section toward a base end section in a projecting direction, wherein the body plate-section of the heat-radiating mounting member includes a third through hole for fixing a panel, the third through hole being configured to house the projecting section, and wherein the planar light emitting panel is mounted on the heat-radiating mounting member by housing the projecting section in the third through hole and fastening a first fastening element in the fastening hole.

9. The illumination apparatus according to claim 1, wherein the heat-radiating mounting member comprises:

a feed element that is electrically connected to the external power source, the feed element being located to the opposite side to the planar light emitting panel with respect to the body plate-section; and a cover member that covers and protects the feed element and part of the connecting wiring section, together with the body plate-section.

10. The illumination apparatus according to claim 9 further comprising: a second fastening element; and a push nut, the second fastening element including: a shaft section; and a cylindrical section that surrounds the shaft section, the push nut including: an annular base section; and a claw section that extends toward a center from the annular base section, wherein the second fastening element is provided across the cover member and the heat-radiating mounting member, the cover member being fixed to the heat-radiating mounting member by the claw section engaging with an outer peripheral surface of the cylindrical section, the heat-radiating mounting member being mounted by inserting the shaft section of the second fastening element into the mounted section.

11. The illumination apparatus according to claim 1,
wherein the heat-radiating mounting member comprises:
a power input board that inputs power from the external power source;
a control board that controls output of the power to the planar light emitting panel; and
an internal wiring member that connects the power input board to the control board.

12. The illumination apparatus according to claim 1,
wherein the heat-radiating mounting member comprises:
an external wiring member that inputs power from the external power source to a power input board: and
a wiring fixing member that fixes the external wiring member,
the external wiring member being at least partially bendable,
the wiring fixing member having a bent groove that houses part of the external wiring member in a bent state,
the bent groove including a locking piece that locks movement of the external wiring member.

13. The illumination apparatus according to claim 2 further comprising at least two of the planar light emitting panels,
wherein the heat-radiating mounting member holds the at least two of the planar light emitting panels at a predetermined interval, and
wherein a shortest distance between the at least two of the planar light emitting panels is greater than a length of the planar light emitting panels.

14. The illumination apparatus according to claim 2 further comprising a plurality of the planar light emitting panels,
wherein the heat-radiating mounting member is long-sized, thereby holding the plurality of the planar light emitting panels linearly side by side in a longitudinal direction.

15. The illumination apparatus according to claim 2,
wherein the body plate-section is made of a galvanized steel plate.

16. The illumination apparatus according to claim 2,
wherein a maximum thickness of a portion where the planar light emitting panel is mounted on the heat-radiating mounting member is not greater than 20 mm.

17. The illumination apparatus according to claim 2,
wherein the planar light emitting panel includes a back-surface supporting case that supports a back surface side of the panel body,
the back-surface supporting case having a second through hole for heat transfer,
the second through hole exposing part of the back surface of the panel body, and
wherein the illumination apparatus further comprises a heat transfer member that blocks most part of the second through hole,
the heat transfer member being constituted by a metal plate,
the heat transfer member including:
one principal surface in surface contact with the panel body; and
an other principal surface in surface contact with the body plate-section.

18. The illumination apparatus according to claim 2,
wherein the planar light emitting panel comprises a back-surface supporting case that supports a back surface side of the panel body,
the back-surface supporting case including a body section and a projecting section that projects from the body section,
the projecting section including a fastening hole that has a depth from a distal end section toward a base end section in a projecting direction,
wherein the body plate-section of the heat-radiating mounting member includes a third through hole for fixing a panel, the third through hole being configured to house the projecting section, and
wherein the planar light emitting panel is mounted on the heat-radiating mounting member by housing the projecting section in the third through hole and fastening a first fastening element in the fastening hole.

19. The illumination apparatus according to claim 2,
wherein the heat-radiating mounting member comprises:
a feed element that is electrically connected to the external power source,
the feed element being located to the opposite side to the planar light emitting panel with respect to the body plate-section; and
a cover member that covers and protects the feed element and part of the connecting wiring section, together with the body plate-section.

20. The illumination apparatus according to claim 19 further comprising: a second fastening element; and a push nut,
the second fastening element including: a shaft section; and a cylindrical section that surrounds the shaft section,
the push nut including: an annular base section; and a claw section that extends toward a center from the annular base section,
wherein the second fastening element is provided across the cover member and the heat-radiating mounting member,
the cover member being fixed to the heat-radiating mounting member by the claw section engaging with an outer peripheral surface of the cylindrical section,
the heat-radiating mounting member being mounted by inserting the shaft section of the second fastening element into the mounted section.

21. The illumination apparatus according to claim 2,
wherein the heat-radiating mounting member comprises:
a power input board that inputs power from the external power source;
a control board that controls output of the power to the planar light emitting panel; and
an internal wiring member that connects the power input board to the control board.

22. The illumination apparatus according to claim 2,
wherein the heat-radiating mounting member comprises:
an external wiring member that inputs power from the external power source to a power input board: and
a wiring fixing member that fixes the external wiring member,
the external wiring member being at least partially bendable,
the wiring fixing member having a bent groove that houses part of the external wiring member in a bent state,
the bent groove including a locking piece that locks movement of the external wiring member.

* * * * *